US010561920B2

(12) United States Patent
Wagner et al.

(10) Patent No.: US 10,561,920 B2
(45) Date of Patent: Feb. 18, 2020

(54) GRAPPLING DUMMY

(71) Applicants: Abraham Mark Wagner, Papillion, NE (US); Joseph Paul Wilk, Manhattan, KS (US)

(72) Inventors: Abraham Mark Wagner, Papillion, NE (US); Joseph Paul Wilk, Manhattan, KS (US)

( * ) Notice: Subject to any disclaimer, the term of this patent is extended or adjusted under 35 U.S.C. 154(b) by 126 days.

(21) Appl. No.: 15/945,509

(22) Filed: Apr. 4, 2018

(65) Prior Publication Data

US 2018/0290039 A1 Oct. 11, 2018

Related U.S. Application Data

(60) Provisional application No. 62/483,055, filed on Apr. 7, 2017.

(51) Int. Cl.
*A63B 69/34* (2006.01)

(52) U.S. Cl.
CPC ..... *A63B 69/345* (2013.01)

(58) Field of Classification Search
CPC ..... A63B 69/20; A63B 69/201; A63B 69/203; A63B 69/32; A63B 69/325; A63B 69/345
See application file for complete search history.

(56) References Cited

U.S. PATENT DOCUMENTS 1,530,519 A * 3/1925 Remington ..... A63B 69/0059 473/216
2,271,312 A * 1/1942 Shorter ..... G03B 15/08 446/375
2,909,370 A * 10/1959 Fortney ..... A63B 69/34 482/83
3,861,676 A * 1/1975 Paul ..... A63B 69/34 482/83
4,088,315 A * 5/1978 Schemmel ..... A63B 69/34 482/4
4,491,315 A * 1/1985 Dye ..... A63B 69/201 473/442
4,946,159 A * 8/1990 Jones ..... A63B 69/004 473/441
5,046,724 A * 9/1991 Sotomayer ..... A63B 69/20 482/90
5,111,771 A * 5/1992 Mathews ..... A01K 15/025 119/708

(Continued)

*Primary Examiner* — Garrett K Atkinson
(74) *Attorney, Agent, or Firm* — Erik M. Antonson; Advent, LLP

(57) ABSTRACT

A grappling dummy having a generally human shape includes a trunk with a head, arms, and legs extending from the trunk. The legs can be connected together by a connecting leg segment forming a leg enclosure. The grappling dummy also includes padding disposed about the trunk, the head, the arms, and the legs. The trunk defines a midline, and the head can extend longitudinally from the trunk angled in a forward direction from the midline at about forty-five degrees. Each of the arms can extend from the trunk at about forty-five degrees. Each of the arms can lie in a generally transverse plane with respect to the midline. Each of the legs can extend from the trunk at about forty-five degrees. Each of the legs can lie in a second plane angled in a forward direction from the midline of the trunk at about forty-five degrees.

5 Claims, 26 Drawing Sheets

(56) References Cited

U.S. PATENT DOCUMENTS 5,256,069 A * 10/1993 Snowden, Jr. ..... A63B 69/34 434/247
5,281,191 A * 1/1994 DeSousa ..... A63B 69/34 473/442
5,554,088 A * 9/1996 Zlojutro ..... A63B 69/004 482/83
5,697,872 A * 12/1997 Stronsick, Jr. ..... A63B 69/34 482/83
5,702,327 A * 12/1997 Fullbright ..... A63B 69/20 473/441
5,902,217 A * 5/1999 Schechner ..... A63B 69/201 482/83
6,063,011 A * 5/2000 Pelchat ..... A63B 69/004 482/83
6,139,328 A * 10/2000 Picotte ..... A63B 69/345 434/247
6,155,960 A * 12/2000 Roberts ..... A63B 69/34 482/83
6,302,831 B1 * 10/2001 Henry ..... A63B 69/004 482/83
6,432,027 B1 * 8/2002 Haselrig ..... A63B 69/201 482/83
7,147,579 B2 * 12/2006 Forrest ..... A63B 69/345 473/441
D584,785 S * 1/2009 McDonald ..... D21/787
7,678,028 B1 * 3/2010 Gore ..... A63B 69/004 482/86
D697,157 S * 1/2014 Siklosi ..... A63B 69/004 D21/787
D731,012 S * 6/2015 Gilman ..... D21/635
9,050,514 B1 * 6/2015 Mirza ..... A63B 69/004
9,504,893 B2 * 11/2016 Nelson ..... A63B 69/205
D792,933 S * 7/2017 Warner ..... D21/787
9,878,197 B2 * 1/2018 Mayes ..... A63H 33/00
D812,171 S * 3/2018 Rodriguez ..... D21/787
2004/0053754 A1 * 3/2004 Tatton ..... A63B 21/055 482/83
2005/0167925 A1 * 8/2005 Lewis ..... A63B 69/004 273/403
2007/0298911 A1 * 12/2007 Bridge ..... A63B 69/0071 473/422
2011/0256990 A1 * 10/2011 Machado ..... A63B 69/004 482/83
2013/0137554 A1 * 5/2013 Knight ..... A63B 69/345 482/85
2014/0378281 A1 * 12/2014 Mazi ..... A63B 69/34 482/83

* cited by examiner

GRAPPLING DUMMY

CROSS-REFERENCE TO RELATED APPLICATIONS

The present application claims the benefit under 35 U.S.C. § 119(e) of U.S. Provisional Application Ser. No. 62/483,055, filed Apr. 7, 2017, and titled "GRAPPLING DUMMY," which is herein incorporated by reference in its entirety.

BACKGROUND

The term "martial arts" generally refers to systems and traditions of combat practices. The term "mixed martial arts" (MMA) refers to combat that includes both striking and grappling, encompassing techniques from martial arts as well as from various other combat sports. Brazilian jiu-jitsu is a martial art combat system that emphasizes grappling and ground fighting.

DRAWINGS

The Detailed Description is described with reference to the accompanying figures. The use of the same reference numbers in different instances in the description and the figures may indicate similar or identical items.

DETAILED DESCRIPTION

Referring generally to FIGS. 1 through 25, a grappling dummy 100 having a generally human shape is described.

Figure 3:
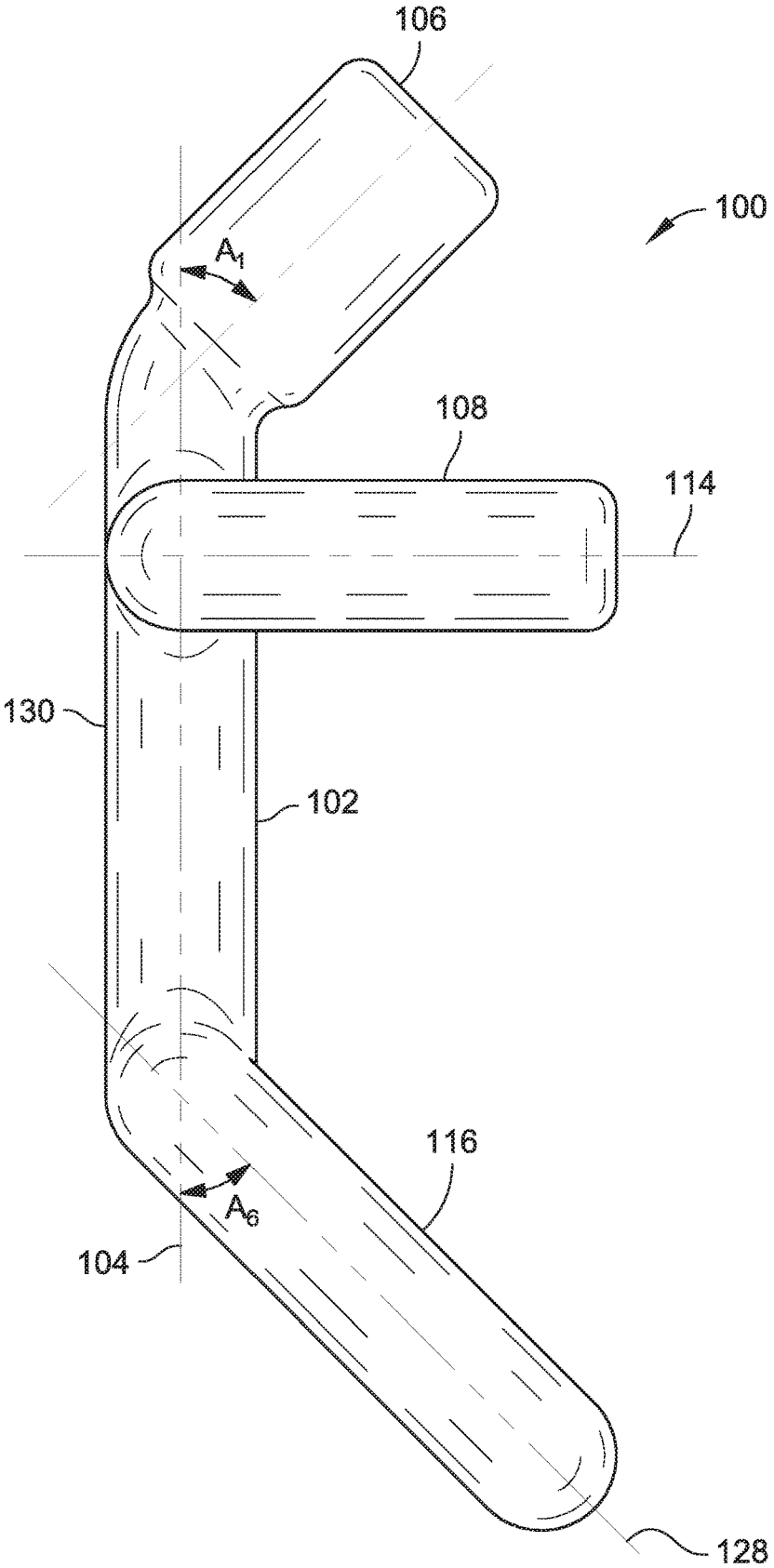
FIG. 3 is a side view of the grappling dummy illustrated in FIG. 1.
Figure 4:
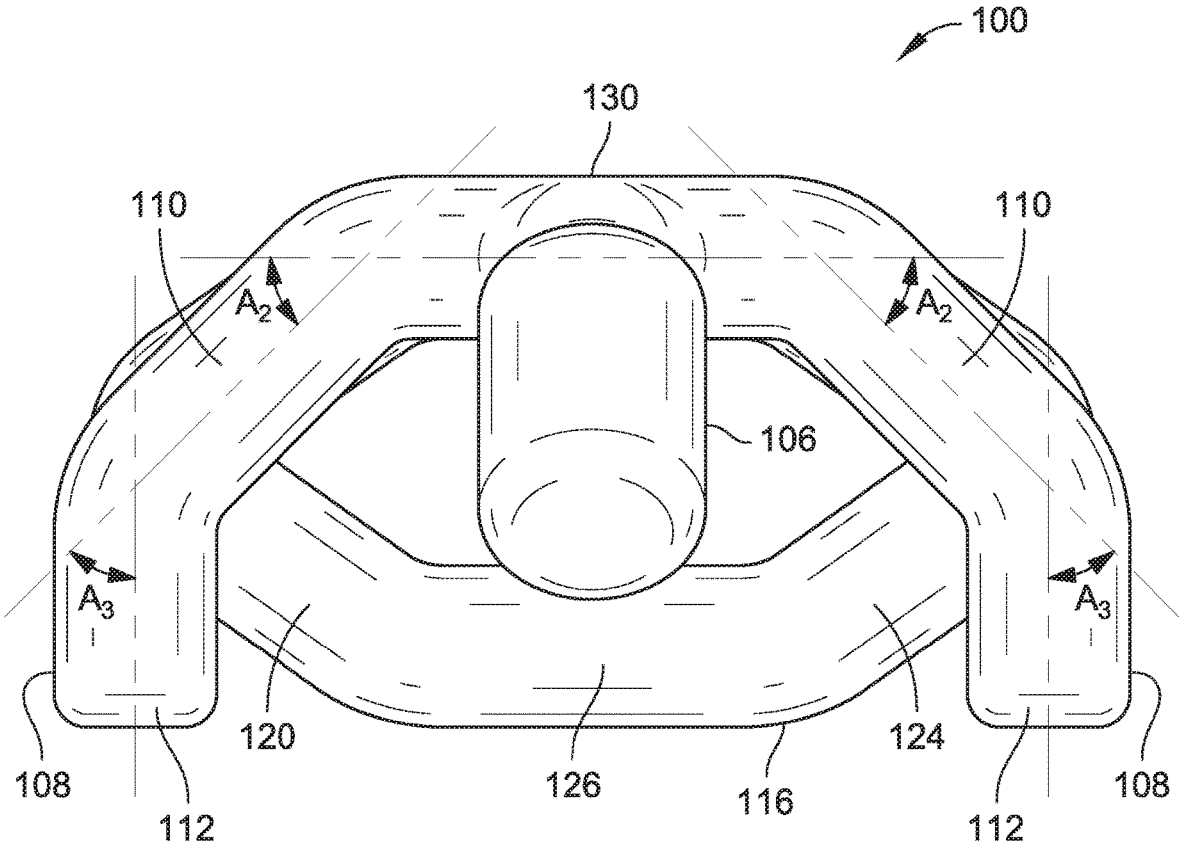
FIG. 4 is a top view of the grappling dummy illustrated in FIG. 1.
Figure 5:
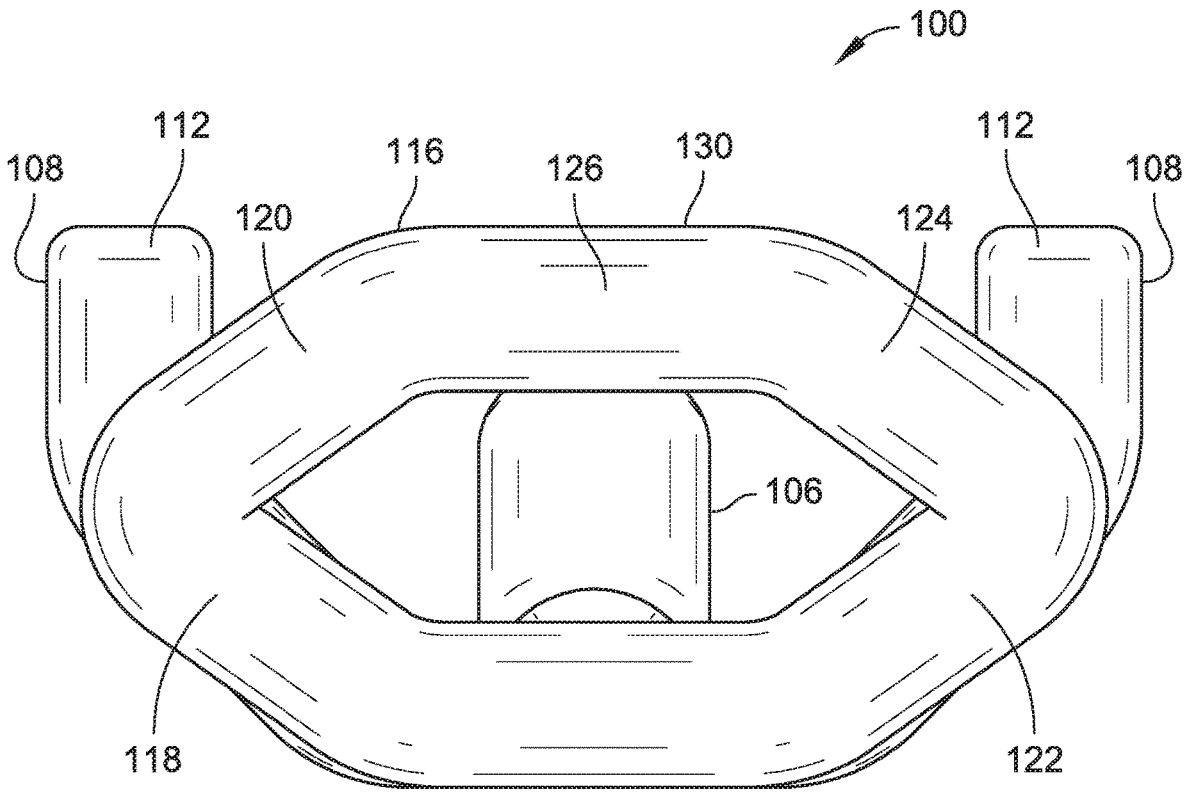
FIG. 5 is a bottom view of the grappling dummy illustrated in FIG. 1.

The grappling dummy 100 includes a trunk 102 defining a midline 104 (FIG. 3). The grappling dummy 100 also includes a head 106 extending longitudinally from the trunk 102 and angled (flexed) in a forward direction from the midline 104 of the trunk 102 at an angle $A_1$ of about forty-five degrees (45°) (FIG. 3). For example, the flexion of the head 106 of the grappling dummy 100 is analogous to about forty-five degrees (45°) of cervical flexion of human anatomy. The grappling dummy 100 also includes two arms 108, where each arm 108 includes a proximal arm segment 110 extending from the trunk 102 at an angle $A_2$ of about forty-five degrees (45°) and a distal arm segment 112 extending from the proximal arm segment 110 at an angle $A_3$ of about forty-five degrees (45°) (FIG. 4). In embodiments of the disclosure, each one of the proximal arm segments 110 and the distal arm segments 112 lies in a generally transverse plane 114 with respect to the midline 104 of the trunk 102 (FIG. 3).

Figure 1:
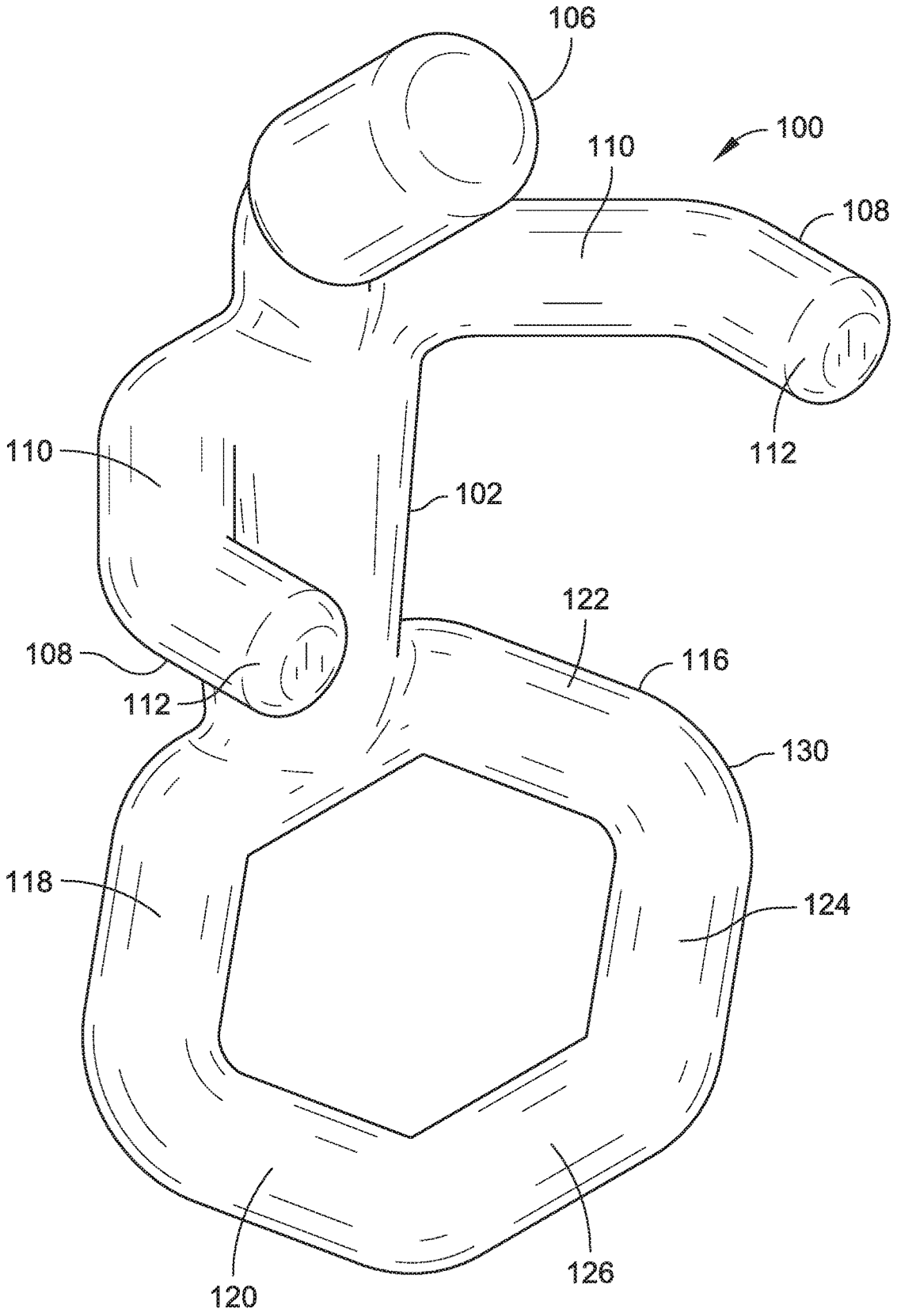
FIG. 1 is an isometric view illustrating a grappling dummy in accordance with an example embodiment of the present disclosure.
Figure 2:
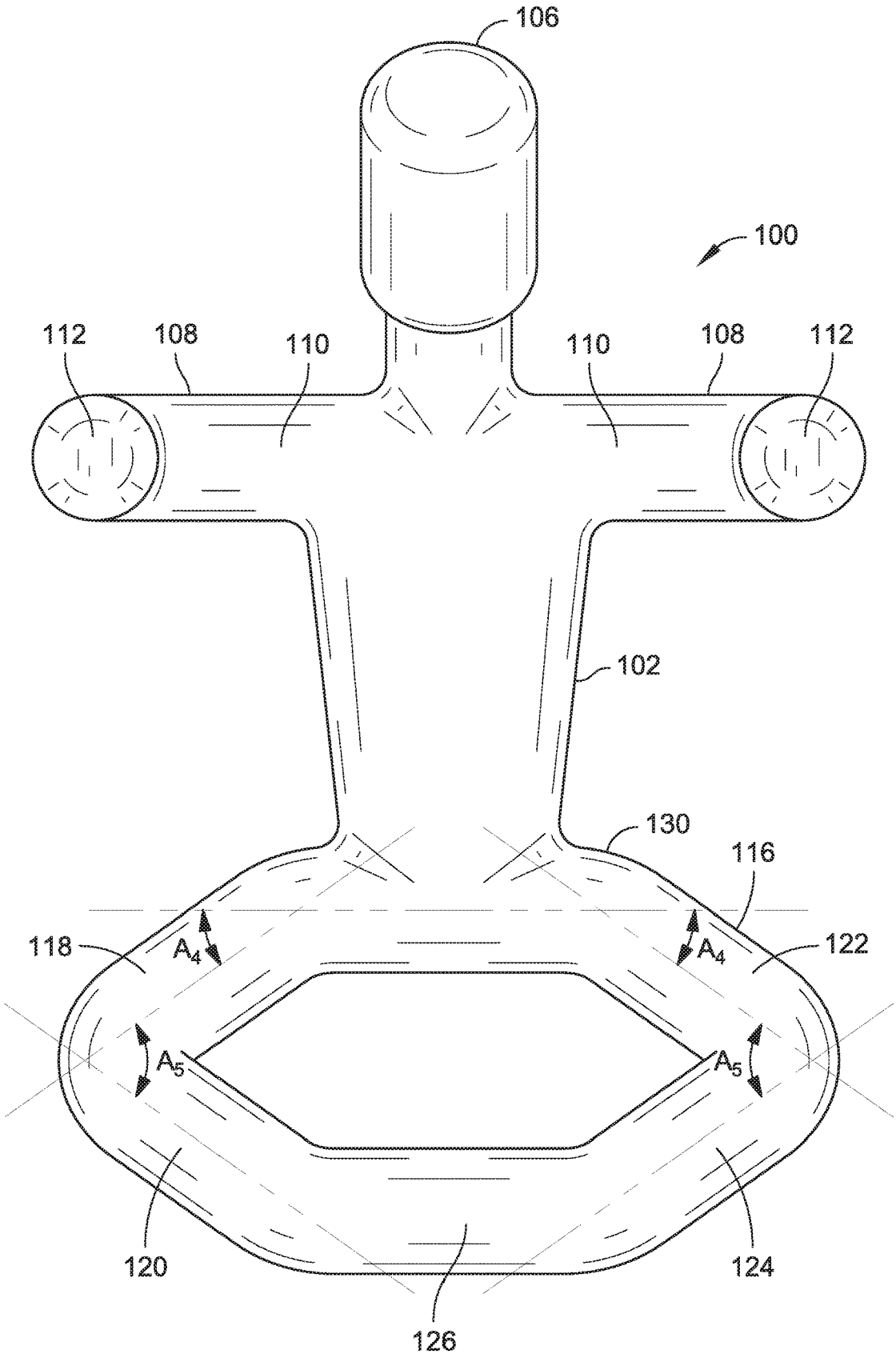
FIG. 2 is a front view of the grappling dummy illustrated in FIG. 1.

The grappling dummy 100 further includes a leg enclosure 116. The leg enclosure 116 includes a proximal leg segment 118 extending from the trunk 102 at an angle $A_4$ of about forty-five degrees (45°) and a distal leg segment 120 extending from the proximal leg segment 118 at an angle $A_5$ of about ninety degrees (90°) (FIG. 2). The grappling dummy 100 also includes an opposing proximal leg segment 122 extending from the trunk 102 at an angle $A_4$ of about forty-five degrees and a distal leg segment 124 extending from the proximal leg segment 122 at an angle $A_5$ of about ninety degrees (FIG. 2). In embodiments of the disclosure, the distal leg segment 120 and the distal leg segment 124 are connected together by a leg segment 126. As described herein, each one of the proximal leg segment 118, the distal leg segment 120, the proximal leg segment 122, the distal leg segment 124, and the leg segment 126 lies in another plane 128 angled in a forward direction from the midline 104 of the trunk 102 at an angle $A_6$ of about forty-five degrees (FIG. 3). For instance, the flexion of the proximal leg segment 118 and the proximal leg segment 122 of the grappling dummy 100 is analogous to about forty-five degrees (45°) of hip flexion of human anatomy, and the external rotation of the proximal leg segment 118 and the proximal leg segment 122 of the grappling dummy 100 is analogous to about forty-five degrees (45°) of hip joint external rotation and femur abduction (e.g., outwardly away from the midline 104 of the grappling dummy 100).

It should be noted that in some embodiments, the leg segment 126 is not necessarily included with the grappling dummy 100. For example, the distal leg segment 120 and the distal leg segment 124 are not necessarily connected together (e.g., in the manner of the unconnected distal arm segments 112). It should also be noted that in some embodiments, the arms 108 may be connected together. For instance, the distal arm segments 112 can be connected together by another arm segment to form an arm enclosure (e.g., in the manner of the leg enclosure 116 formed by connecting the distal leg segment 120 and the distal leg segment 124 together by the leg segment 126).

In embodiments of the disclosure, the grappling dummy 100 includes padding 130 disposed about the trunk 102, the head 106, the arms 108, and the leg enclosure 116. In some embodiments, the padding 130 can be thick, woven fabric (e.g., carpet remnants). In other embodiments, the padding 130 can be rubber, such as extruded foam rubber having a slit down one side and configured to snap over an inner tube. Further, in some embodiments the padding 130 can be coated with a coating, such as tape. The grappling dummy 100 may also be rubber dipped to provide the coating.

In some embodiments, the grappling dummy 100 includes an internal frame (e.g., a rigid internal frame 132) for supporting the padding 130. For example, the rigid internal frame 132 is constructed using tube segments 134 connected by tube fittings 136. In some embodiments, the tube segments 134 and tube fittings 136 can include two-inch diameter (2") polyvinyl chloride (PVC) pipe and fittings. In some embodiments, the tube segments 134 and tube fittings 136 can include three-inch diameter (3") PVC pipe and fittings. However, these dimensions and materials are provided by way of example and are not meant to limit the present disclosure. In other embodiments, tubes, pipes, and/or fittings can have different diameters and/or can be constructed using other materials, including other rigid materials, such as plastics, metals, and so forth.

Figure 6:
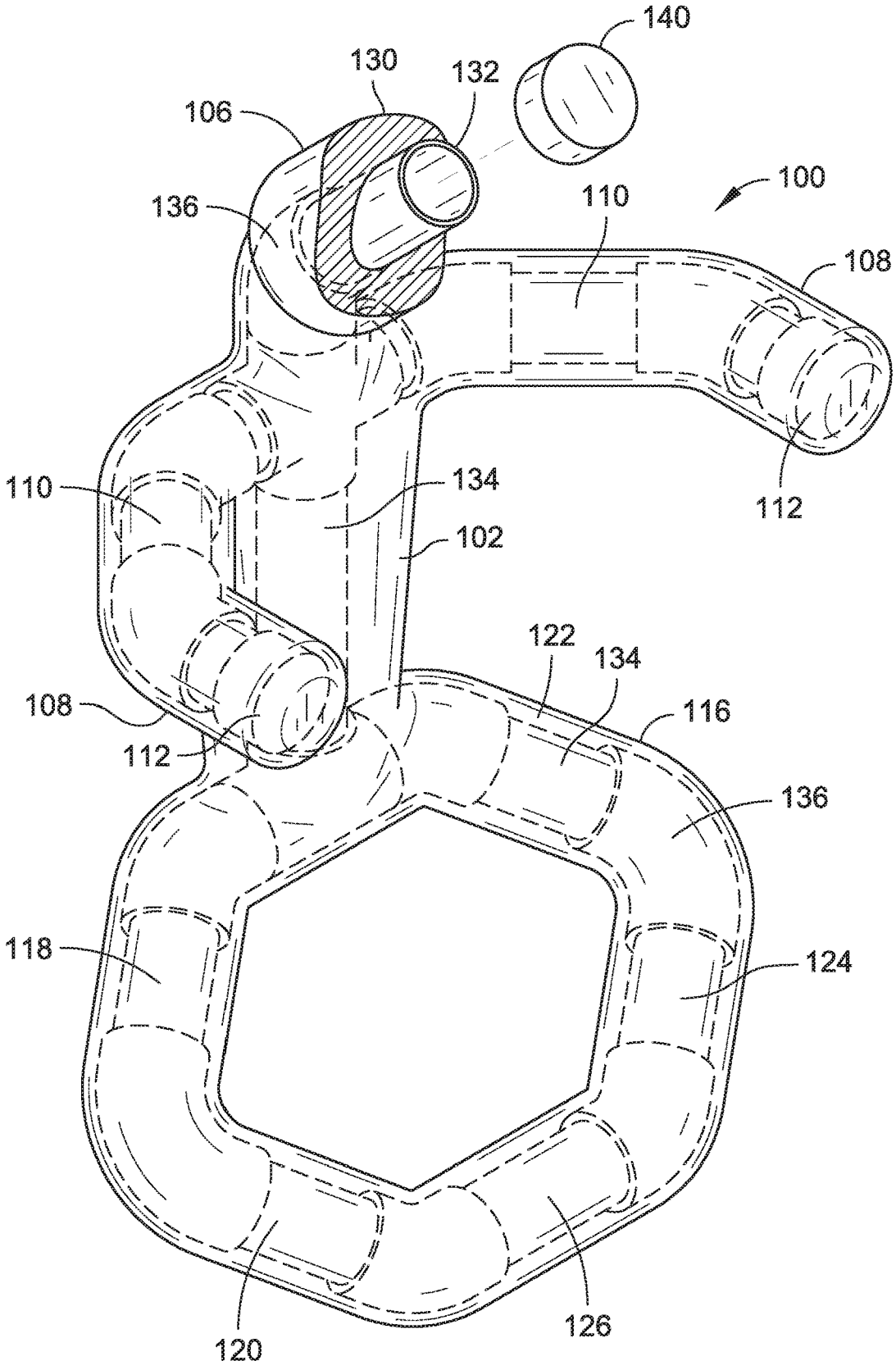
FIG. 6 is a partial cross-sectional isometric view of the grappling dummy illustrated in FIG. 1.
Figure 7:
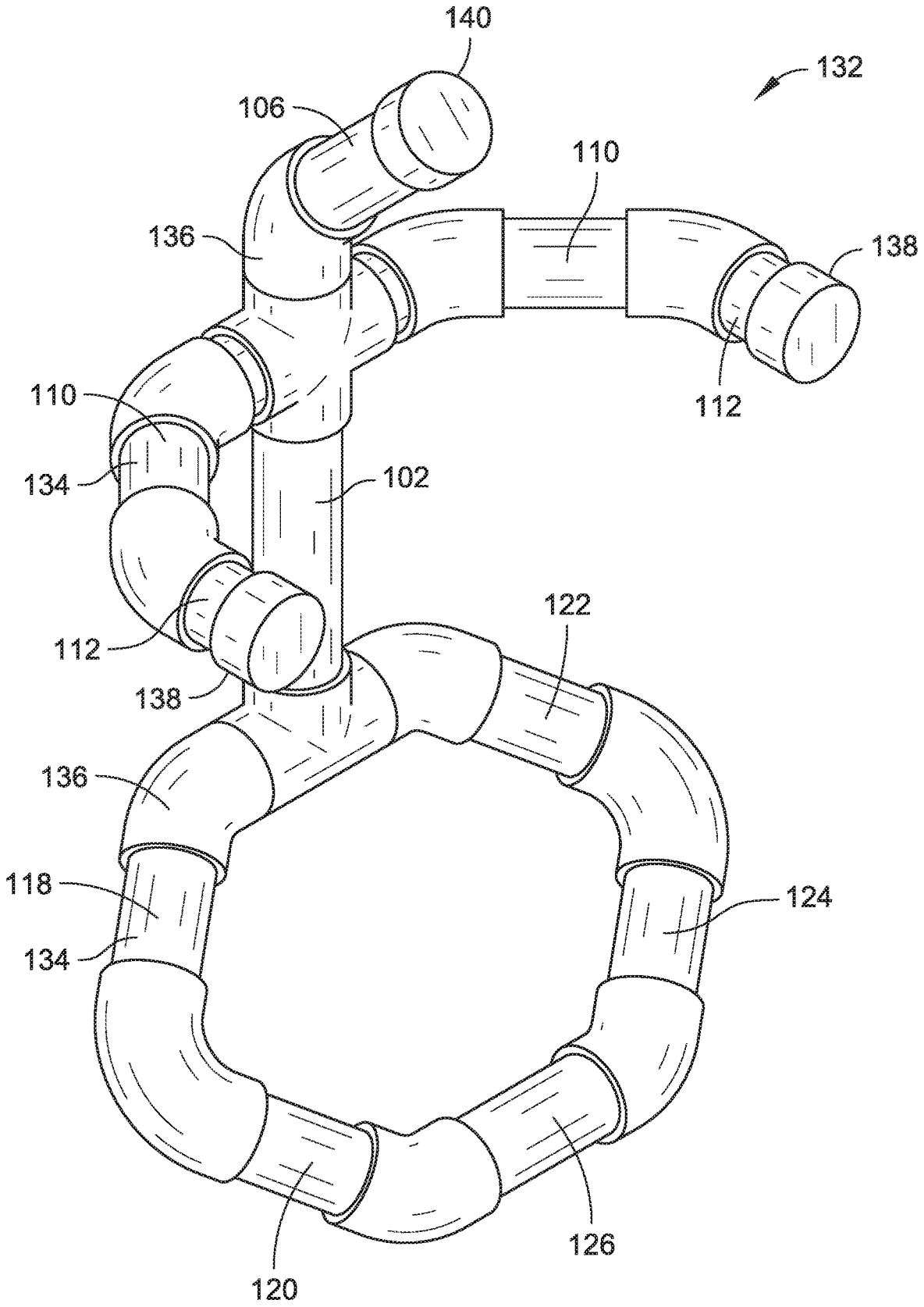
FIG. 7 is an isometric view illustrating a frame for a grappling dummy, such as the grappling dummy illustrated in FIG. 1, in accordance with example embodiments of the present disclosure.
Figure 8:
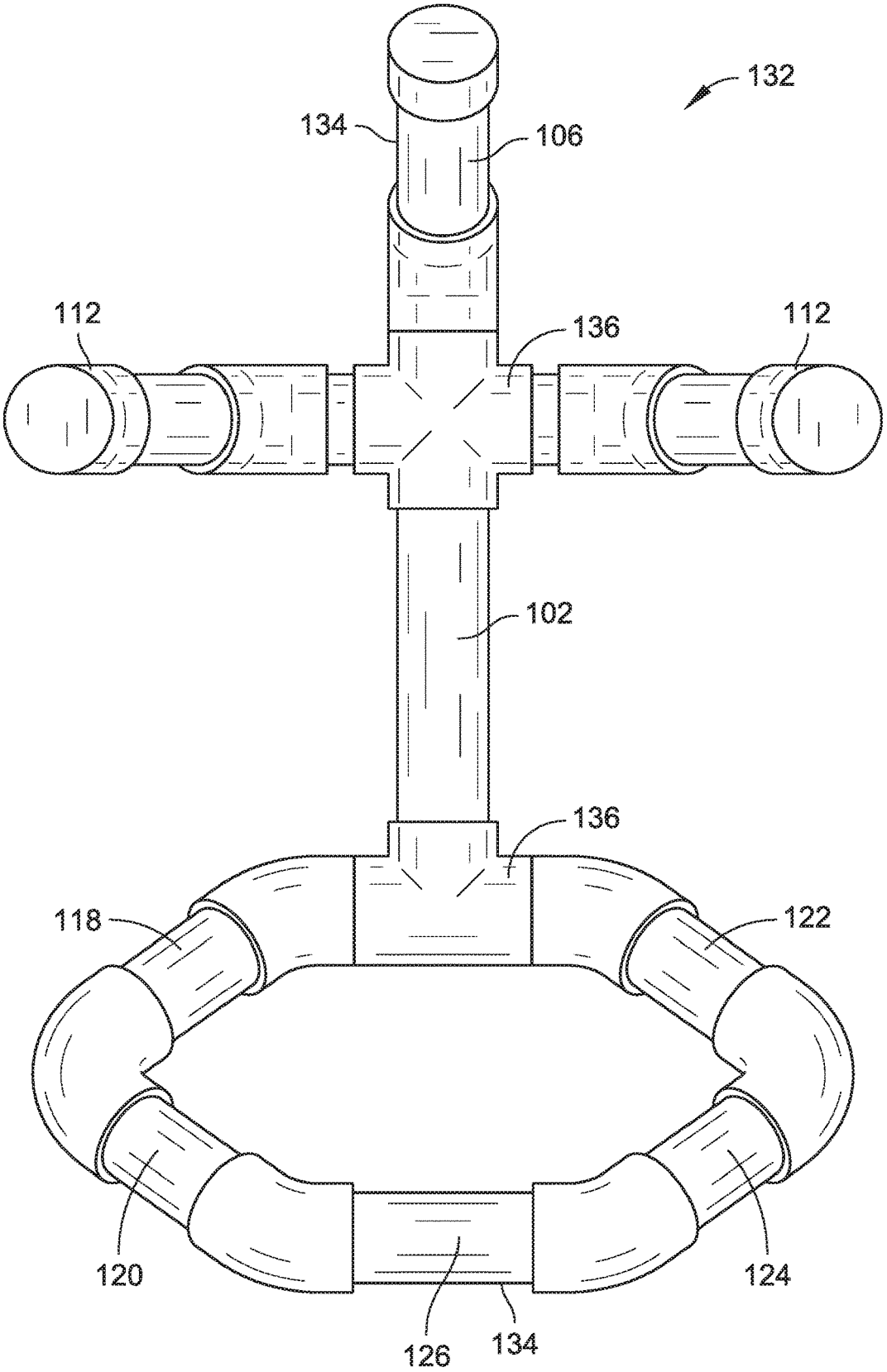
FIG. 8 is a front view of the frame illustrated in FIG. 7.
Figure 9:
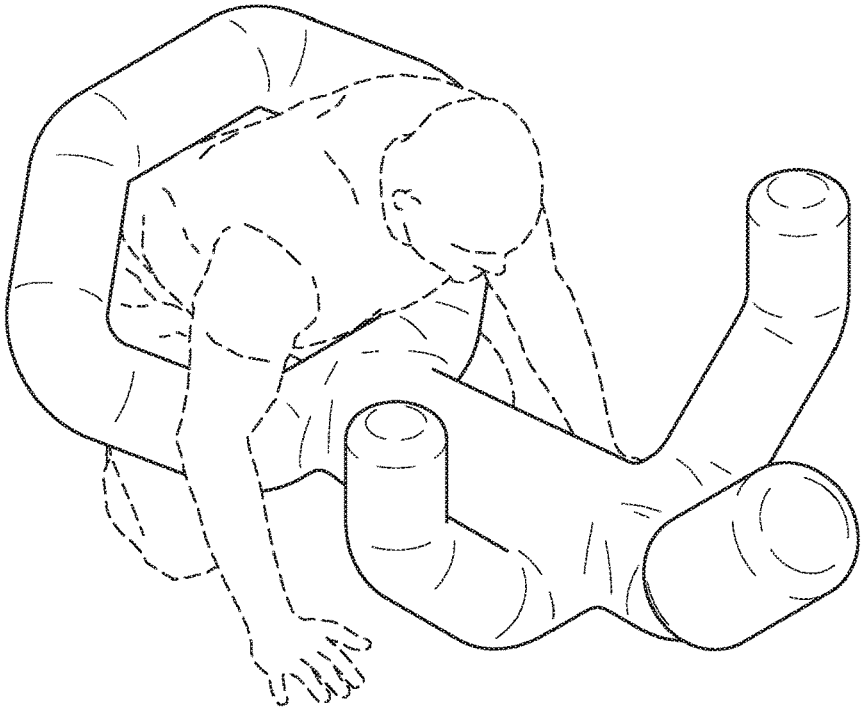
FIG. 9 is an isometric view illustrating a grappling dummy, such as the grappling dummy illustrated in FIG. 1, used in a guard position in accordance with an example embodiment of the present disclosure.
Figure 10:
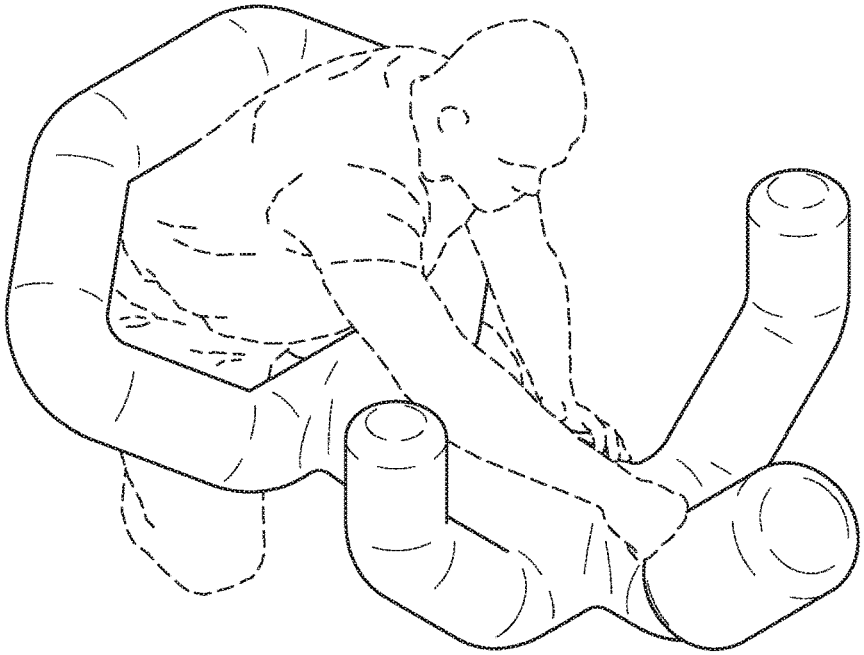
FIG. 10 is an isometric view illustrating a grappling dummy, such as the grappling dummy illustrated in FIG. 1, used in a guard position for a head strike in accordance with an example embodiment of the present disclosure.
Figure 11:
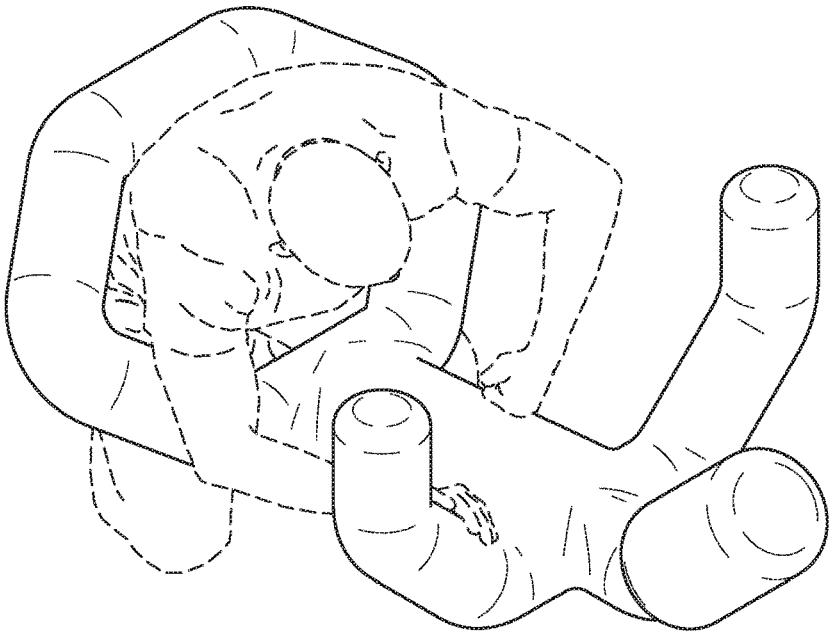
FIG. 11 is an isometric view illustrating a grappling dummy, such as the grappling dummy illustrated in FIG. 1, used in a guard position for a body strike in accordance with an example embodiment of the present disclosure.

In some embodiments, the rigid internal frame 132 can be at least substantially hollow to be filled with granular material (e.g., sand) to weight the grappling dummy 100. In this configuration, the grappling dummy 100 can be shipped with an empty frame, which can be filled with the granular material upon receipt. As shown in FIGS. 6 through 8, ends of the tube segments 134 and/or tube fittings 136 may be closed off with caps. For example, a permanent cap fitting 138 is included at each end of the distal arm segments 112 (e.g., to facilitate retention of the granular material), and a removable cap fitting 140 is included at the end of the head 106 (e.g., for filling and then retaining the granular material). However, in other embodiments, removable and/or permanent caps can be included at different positions.

In some embodiments, the head 106 and/or limbs (e.g., the arms 108 and/or the leg enclosure 116) of the grappling dummy 100 may be positionable and/or repositionable (e.g., dynamically repositionable). For example, one or more of the angles $A_1$ through $A_6$ and/or other angles of the grappling dummy 100 may be adjusted to another angle. In some embodiments, the head and/or limbs of the rigid internal frame 132 can be glued into place (e.g., using PVC solvent cement or another adhesive). In some embodiments, the head and/or limbs can be connected to the trunk 102 by one or more detents, e.g., using a catch mechanism that allow the head or limb to be manipulated into various positions and/or angles, where further rotation of the head or limb is mechanically resisted and/or arrested. Further, in some embodiments, the head and/or limbs can be connected to the trunk 102 by one or more ratchets, e.g., using angled teeth engaged by a pawl, cog, or tooth, possibly allowing motion in one direction only.

It should also be noted that the grappling dummy 100 may be sized differently for differently sized fighters. For example, one grappling dummy 100 having a first size may be configured for a fighter between about five-feet and five-feet six-inches (5'-5'6") tall, another grappling dummy 100 having a second, larger size may be configured for a fighter between about five-feet six-inches and six-feet (5'6"-6') tall, and a further grappling dummy 100 having a third, even larger size may be configured for a fighter between about six-feet and six-feet six-inches (6'-6' 6") tall. In some embodiments, the length dimensions of the trunk 102, the head 106 and/or limbs (e.g., the arms 108 and/or the leg enclosure 116) of the grappling dummy 100 may be scaled proportionately (e.g., as a percentage) for these various fighter height ranges.

Figure 12:
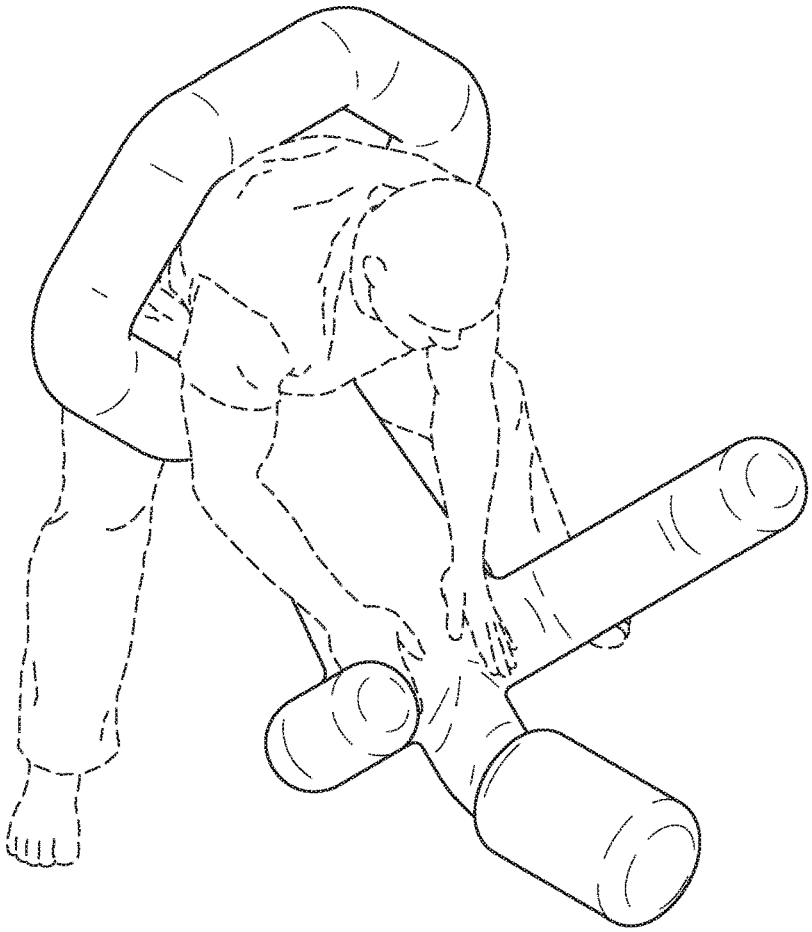
FIG. 12 is an isometric view illustrating a grappling dummy, such as the grappling dummy illustrated in FIG. 1, used in a standing guard position in accordance with an example embodiment of the present disclosure.

In embodiments of the disclosure a grappling dummy 100 is configured for use in martial arts training, including, but not necessarily limited to: mixed martial arts (MMA) training, Brazilian jiu jitsu training, and so forth. For example, with reference to FIG. 9, the grappling dummy 100 can be used in a guard position. In this position, a trainee can assume a seated position inside the leg enclosure 116 of the grappling dummy 100 (e.g., with the trainee's knees underneath the hips of the grappling dummy 100). In a guard position, the grappling dummy 100 can be used to train for arm control, as well as for close range strikes, such as a head strike (FIG. 10), a body strike (FIG. 11), and so on. Further, the trainee can move to a standing guard position where the dummy's head is chambered, as shown in FIG. 12. It should be noted that in these guard positions, the flexion of the head 106 forward from the midline 104 of the trunk 102 places the head 106 in an anatomically correct position analogous to about forty-five degrees (45°) of cervical flexion of a human opponent.

Figure 13:
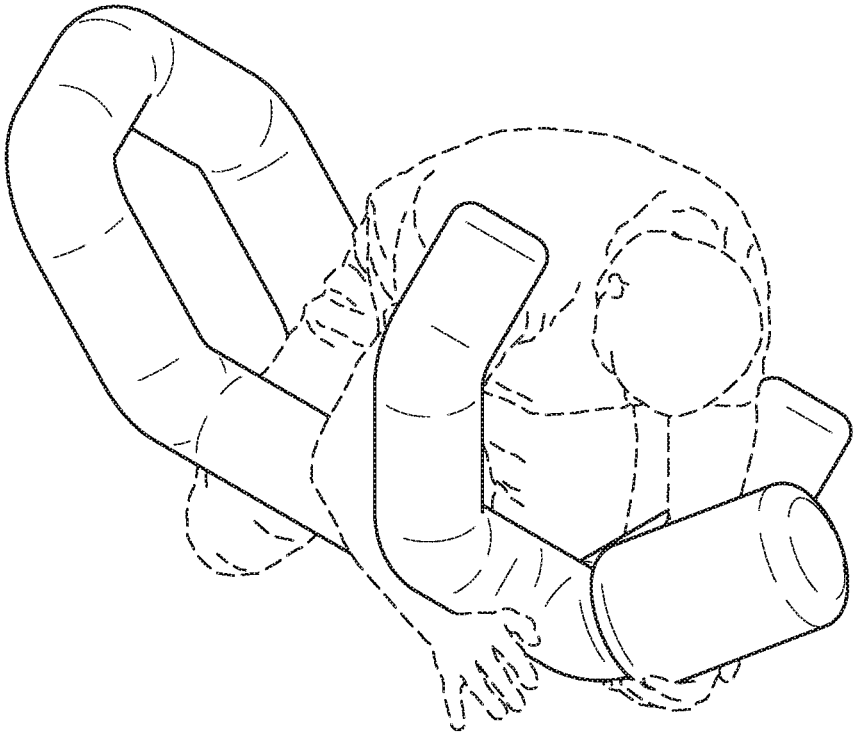
FIG. 13 is an isometric view illustrating a grappling dummy, such as the grappling dummy illustrated in FIG. 1, used in a half-guard position in accordance with an example embodiment of the present disclosure.
Figure 14:
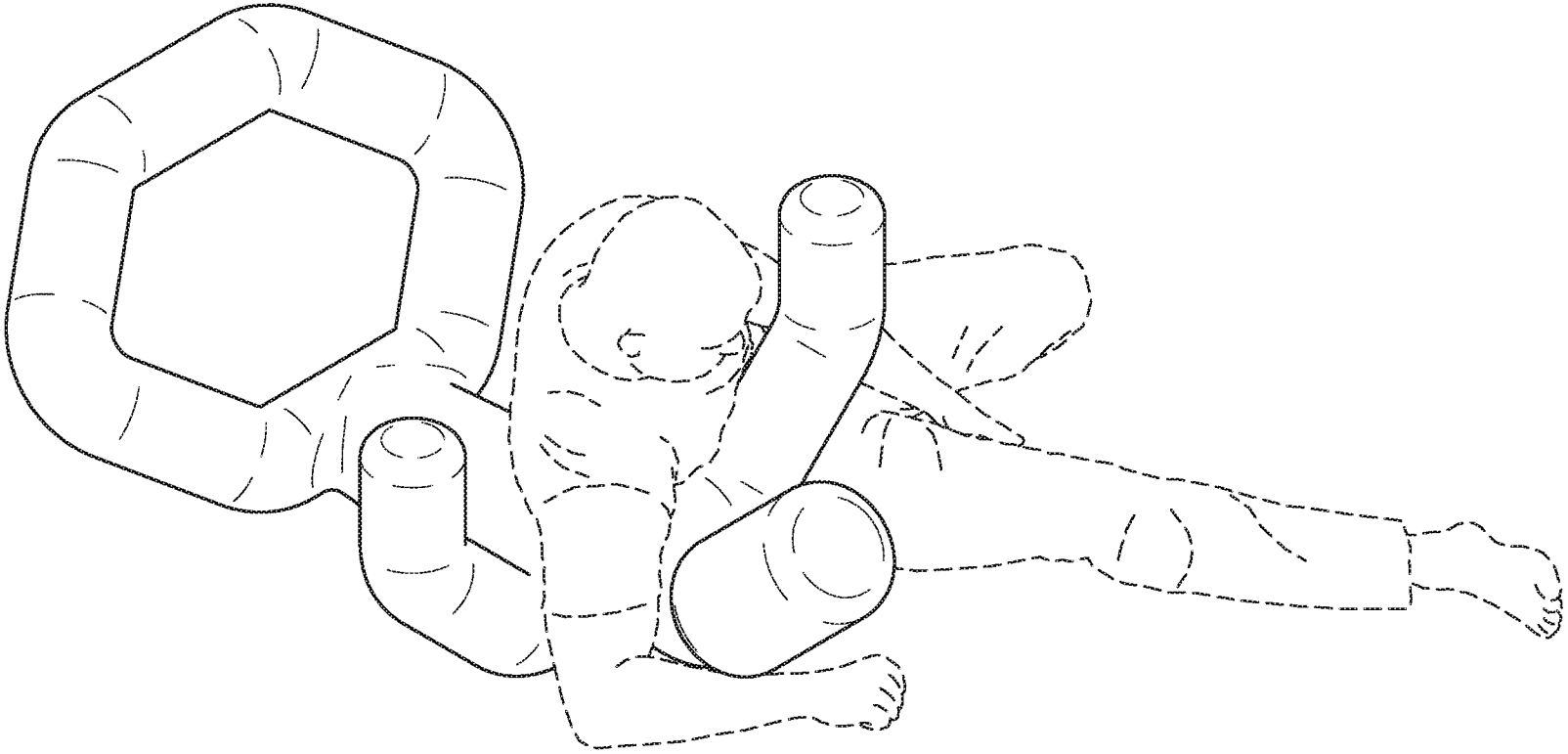
FIG. 14 is an isometric view illustrating a grappling dummy, such as the grappling dummy illustrated in FIG. 1, used in a side control position with a scarf hold in accordance with an example embodiment of the present disclosure.
Figure 15:
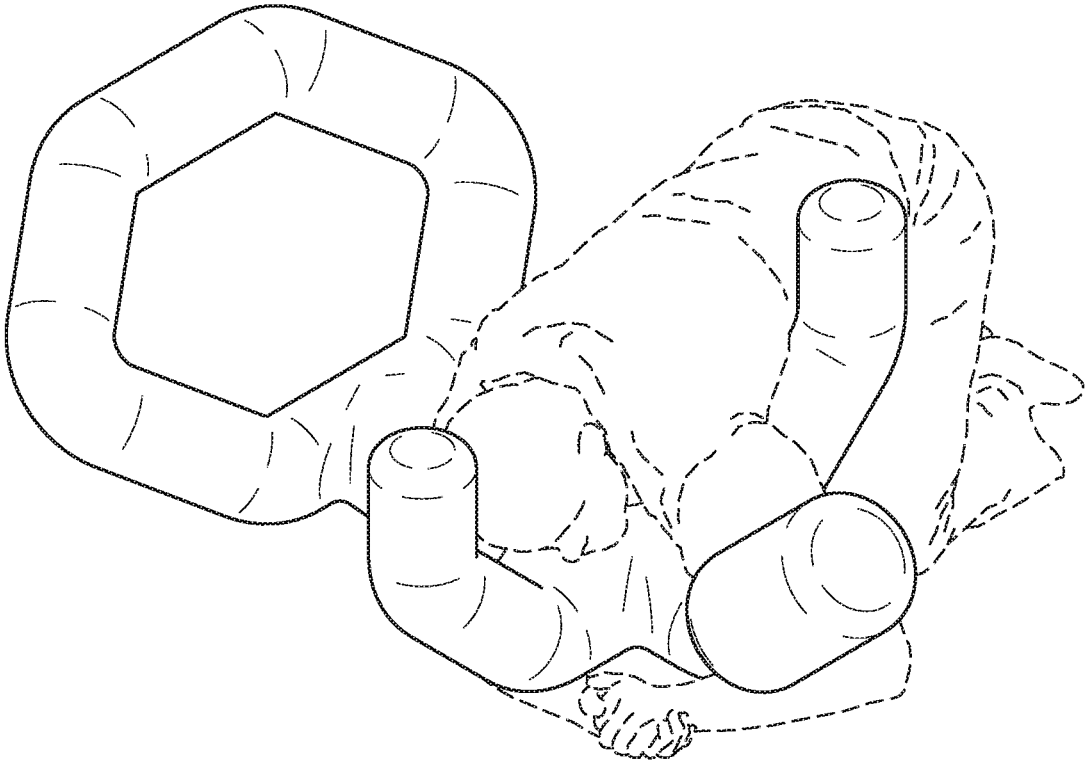
FIG. 15 is an isometric view illustrating a grappling dummy, such as the grappling dummy illustrated in FIG. 1, used in a side control position with an underhook hold in accordance with an example embodiment of the present disclosure.

Referring now to FIG. 13, the grappling dummy 100 can be used in a half-guard position. In this position, the trainee can assume a position seated over the leg enclosure 116 of the grappling dummy 100 (e.g., with the trainee's weight on either side of the leg enclosure 116). In this orientation, the trainee's weight turns the grappling dummy 100 to its elbow to simulate the half-guard position. In a half-guard position, the grappling dummy 100 can be used to train for accurate pressure control, such as shoulder pressure control, hip pressure control, and so forth. It should be noted that in half-guard positions, the extension of the proximal arm segments 110 from the trunk 102 at about forty-five degrees (45°) and the extension of the proximal leg segments 118 and 122 from the trunk 102 at about forty-five degrees (45°) places the grappling dummy 100 in an anatomically correct position when turned to its elbow. From, the half-guard position, the trainee can pass the guard (e.g., into a side control position). In a side control position, the grappling dummy 100 can be used to train for control of the head and/or control under the arm. For instance, the trainee can assume a side control position with a scarf hold or kesa gatame (FIG. 14), a side control position with an underhook hold (FIG. 15), and so on.

Figure 16:
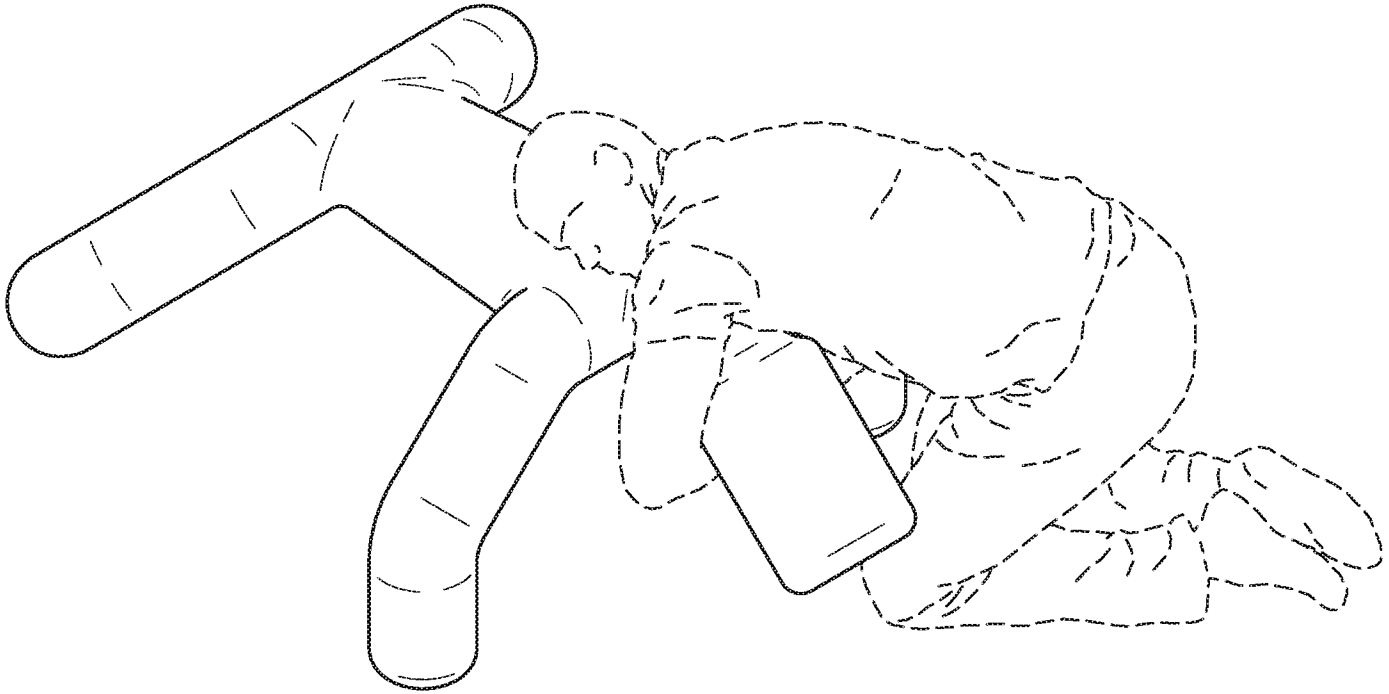
FIG. 16 is an isometric view illustrating a grappling dummy, such as the grappling dummy illustrated in FIG. 1, used in a front headlock position in accordance with an example embodiment of the present disclosure.
Figure 17:
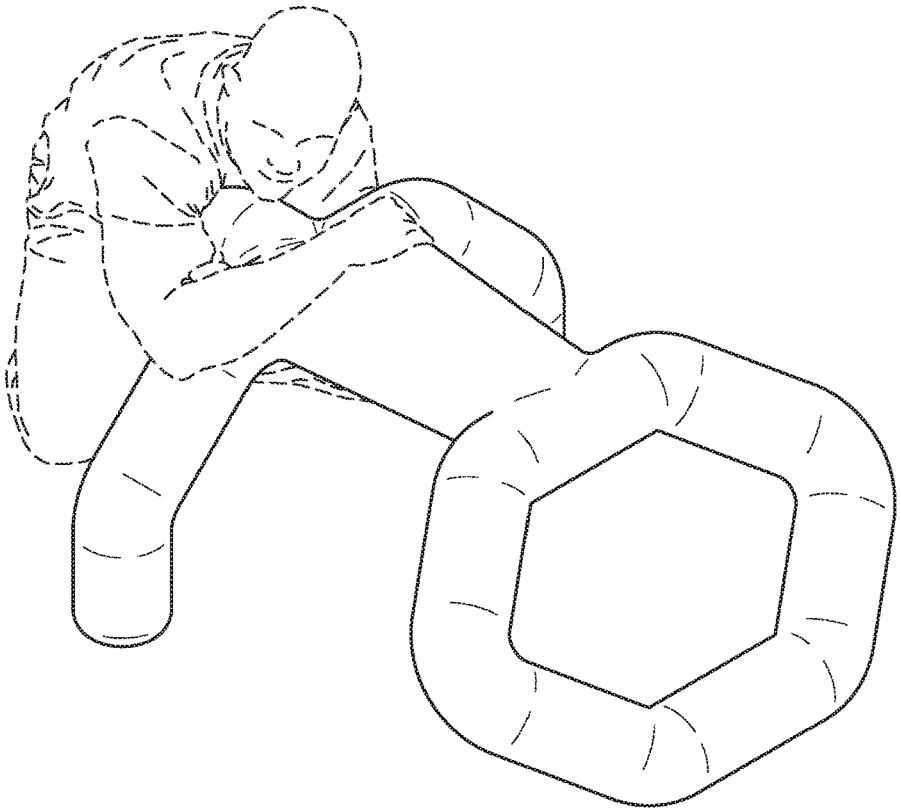
FIG. 17 is an isometric view illustrating a grappling dummy, such as the grappling dummy illustrated in FIG. 1, used in an anaconda choke position in accordance with an example embodiment of the present disclosure.
Figure 18:
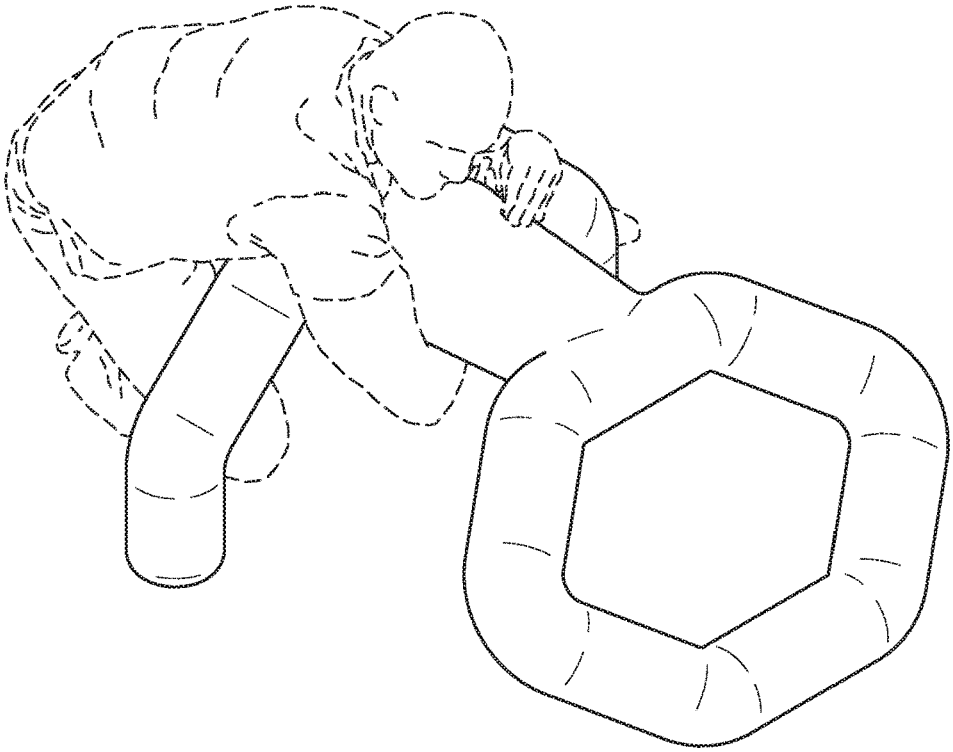
FIG. 18 is an isometric view illustrating a grappling dummy, such as the grappling dummy illustrated in FIG. 1, used in a D'Arce choke position in accordance with an example embodiment of the present disclosure.
Figure 19:
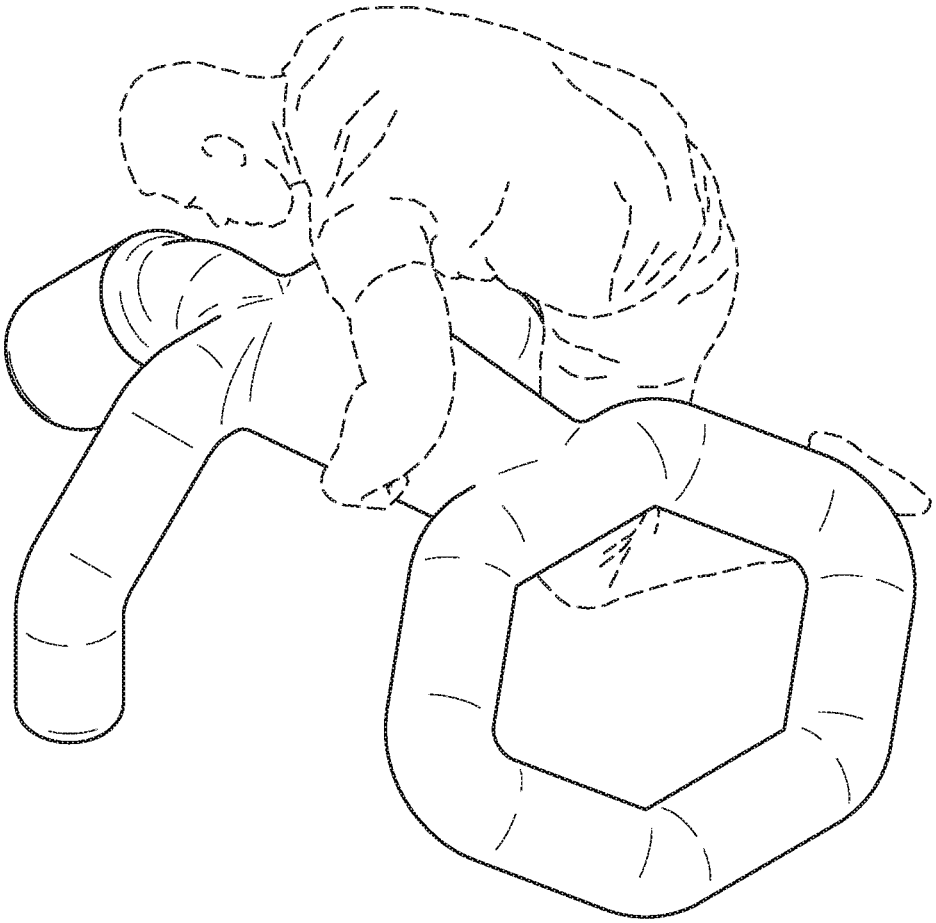
FIG. 19 is an isometric view illustrating a grappling dummy, such as the grappling dummy illustrated in FIG. 1, used in a back position in accordance with an example embodiment of the present disclosure.
Figure 20:
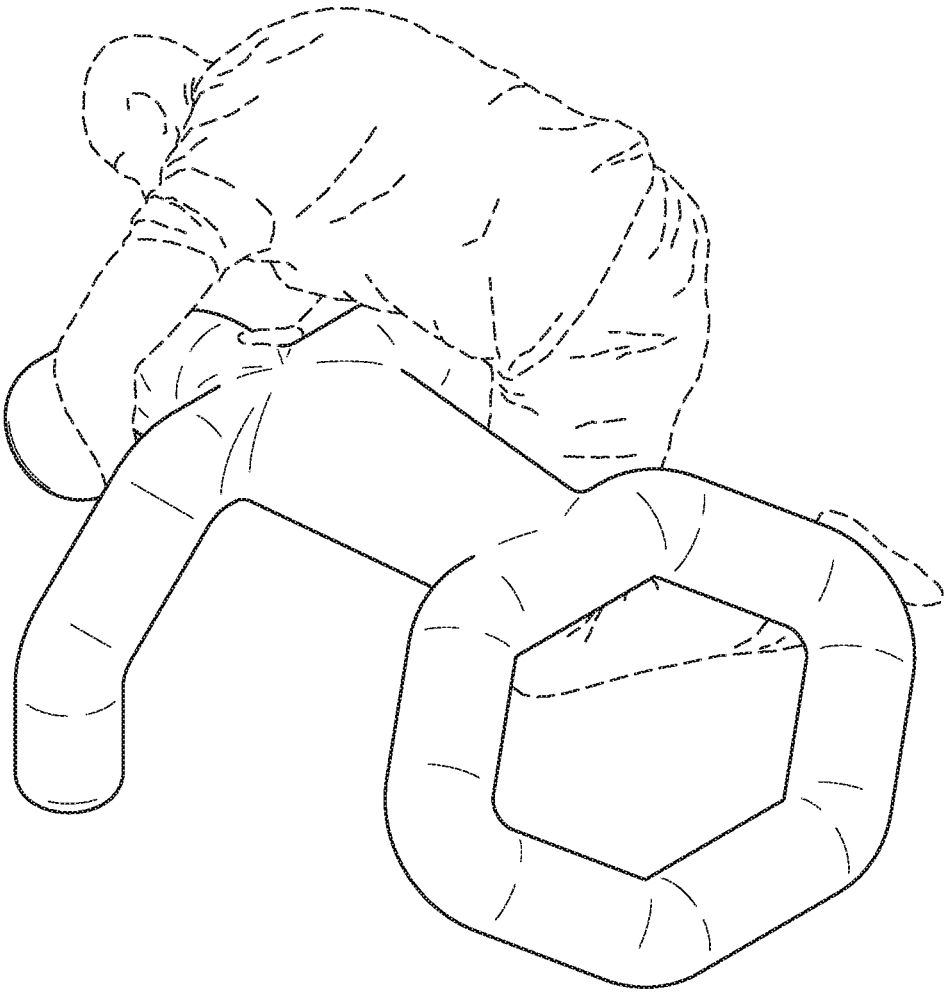
FIG. 20 is an isometric view illustrating a grappling dummy, such as the grappling dummy illustrated in FIG. 1, used in a back position for a head strike in accordance with an example embodiment of the present disclosure.
Figure 21:
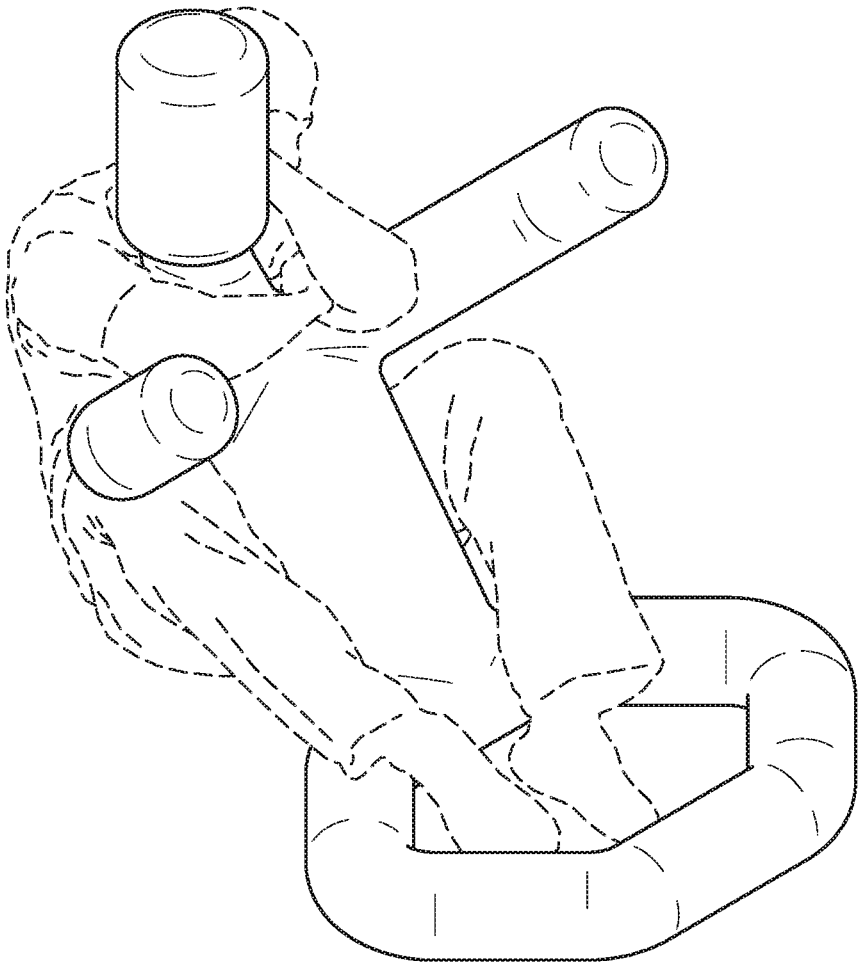
FIG. 21 is an isometric view illustrating a grappling dummy, such as the grappling dummy illustrated in FIG. 1, used in a rear naked choke position in accordance with an example embodiment of the present disclosure.
Figure 22:
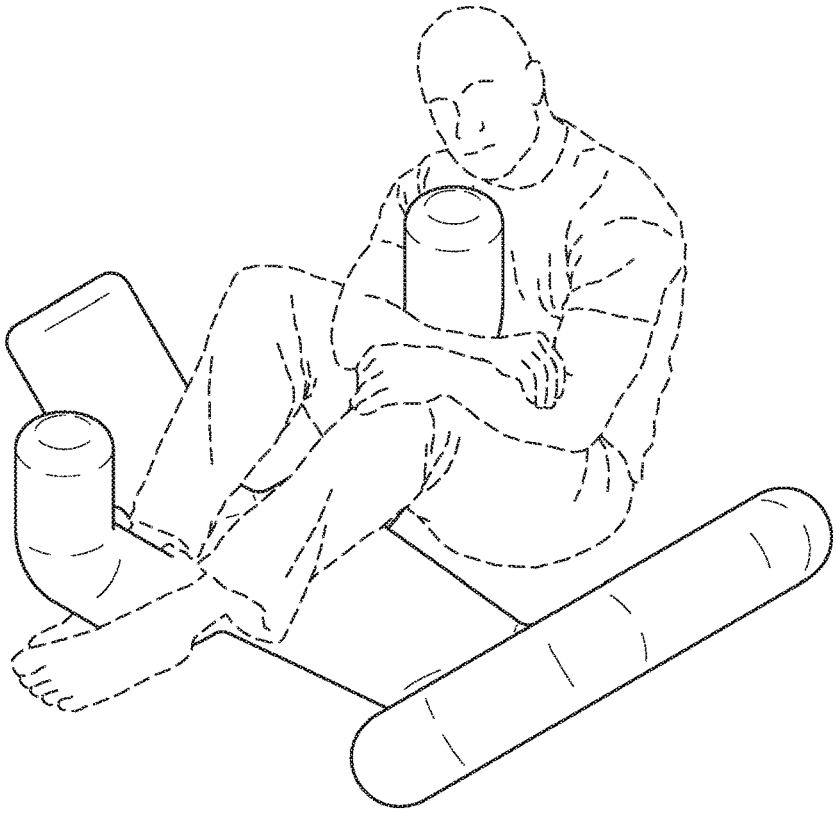
FIG. 22 is an isometric view illustrating a grappling dummy, such as the grappling dummy illustrated in FIG. 1, used in a finish arm bar position in accordance with an example embodiment of the present disclosure.
Figure 23:
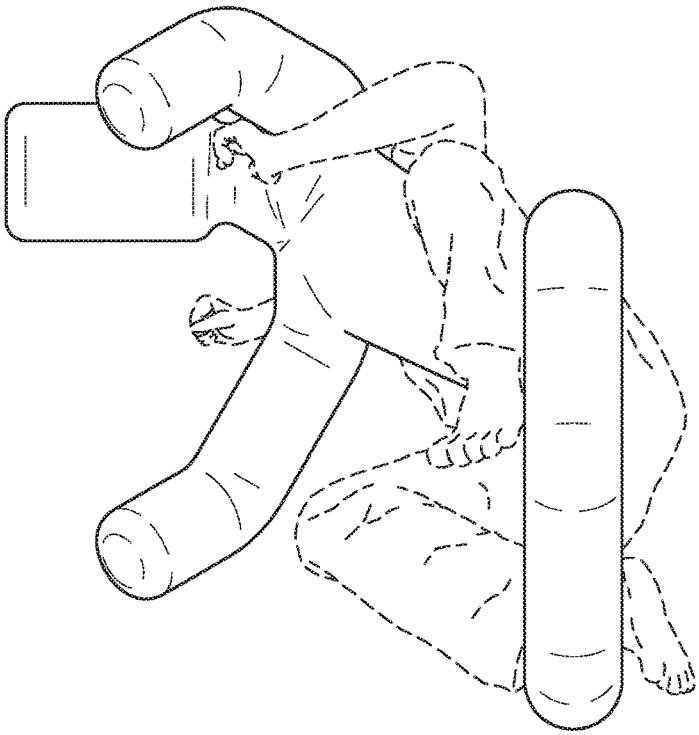
FIG. 23 is an isometric view illustrating a grappling dummy, such as the grappling dummy illustrated in FIG. 1, used in a taking the back position in accordance with an example embodiment of the present disclosure.
Figure 24:
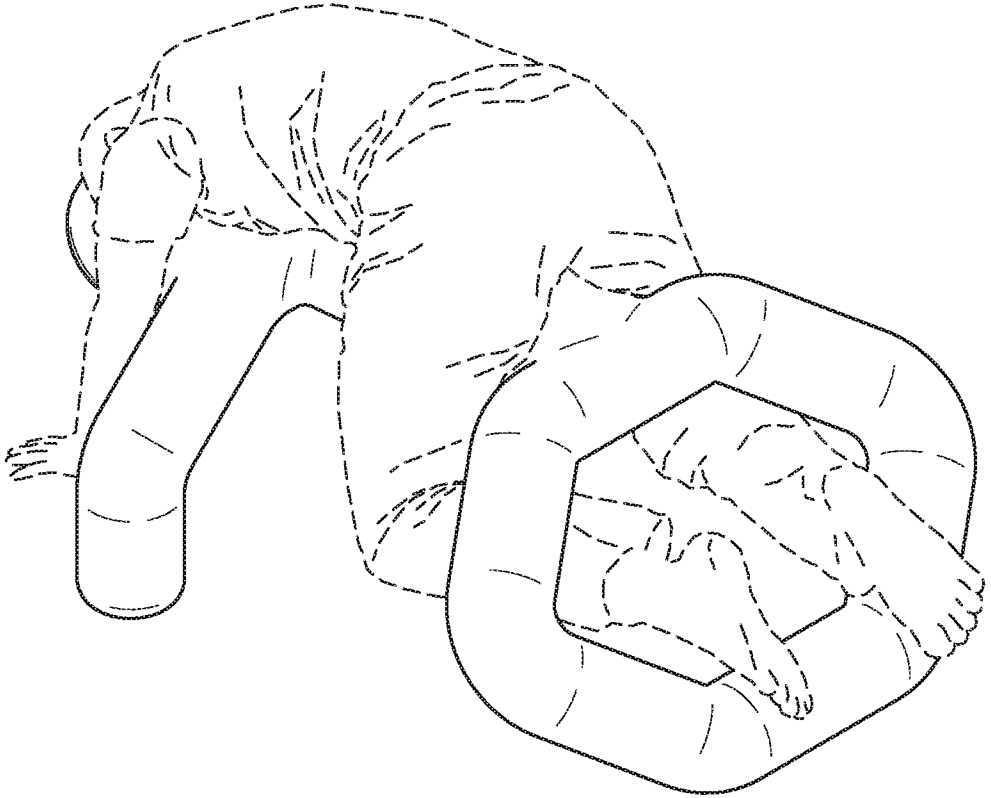
FIG. 24 is an isometric view illustrating a grappling dummy, such as the grappling dummy illustrated in FIG. 1, used in another taking the back position in accordance with an example embodiment of the present disclosure.

The grappling dummy 100 can be used in a turtle position. In this position, the grappling dummy 100 rests on the ground in a "kneeling" position, e.g., where the distal arm segments 112 and the distal leg segments 120 and 124 or the leg segment 126 support the dummy with the midline 104 of the trunk 102 generally parallel to the ground. With reference to FIG. 16, the grappling dummy 100 can be used in a front headlock position. Additionally, the grappling dummy 100 can be used for guillotine setups, including an anaconda choke position (FIG. 17), a D'Arce choke position (FIG. 18), and so forth. With reference to FIG. 19, the grappling dummy 100 can be used in a back position. In a back position, the grappling dummy 100 can also be used to train for close range strikes, such as a head strike (FIG. 20). Additionally, the grappling dummy 100 can be used in a rear naked choke position (FIG. 21), a finish arm bar position (FIG. 22), and various taking the back positions (FIGS. 23 and 24).

Figure 25:
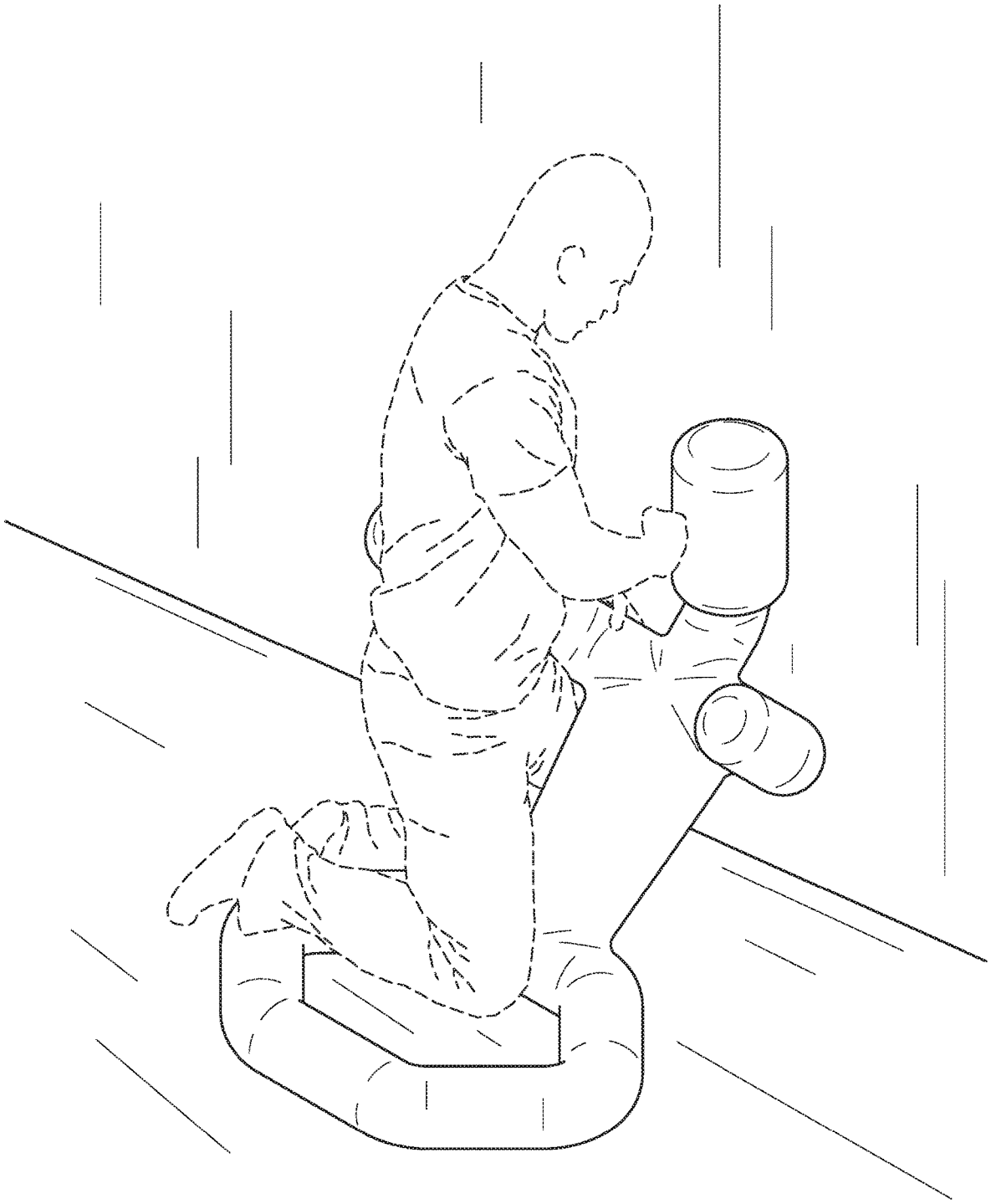
FIG. 25 is an isometric view illustrating a grappling dummy, such as the grappling dummy illustrated in FIG. 1, used in a cage wall position in accordance with an example embodiment of the present disclosure.

With reference to FIG. 25, the grappling dummy 100 can be used in a cage wall position. In this position, the trainee can assume a position seated, kneeling, or standing over the grappling dummy 100, and the dummy can be used to train for close range strikes, such as a head strike. It should be noted that in the cage wall position, the flexion of the head 106, and the proximal leg segments 118 and 122, distal leg segments 120 and 124, and leg segment 126 forward from the midline 104 of the trunk 102 places the grappling dummy 100 in an anatomically correct position when seated against a wall.

Figure 26:
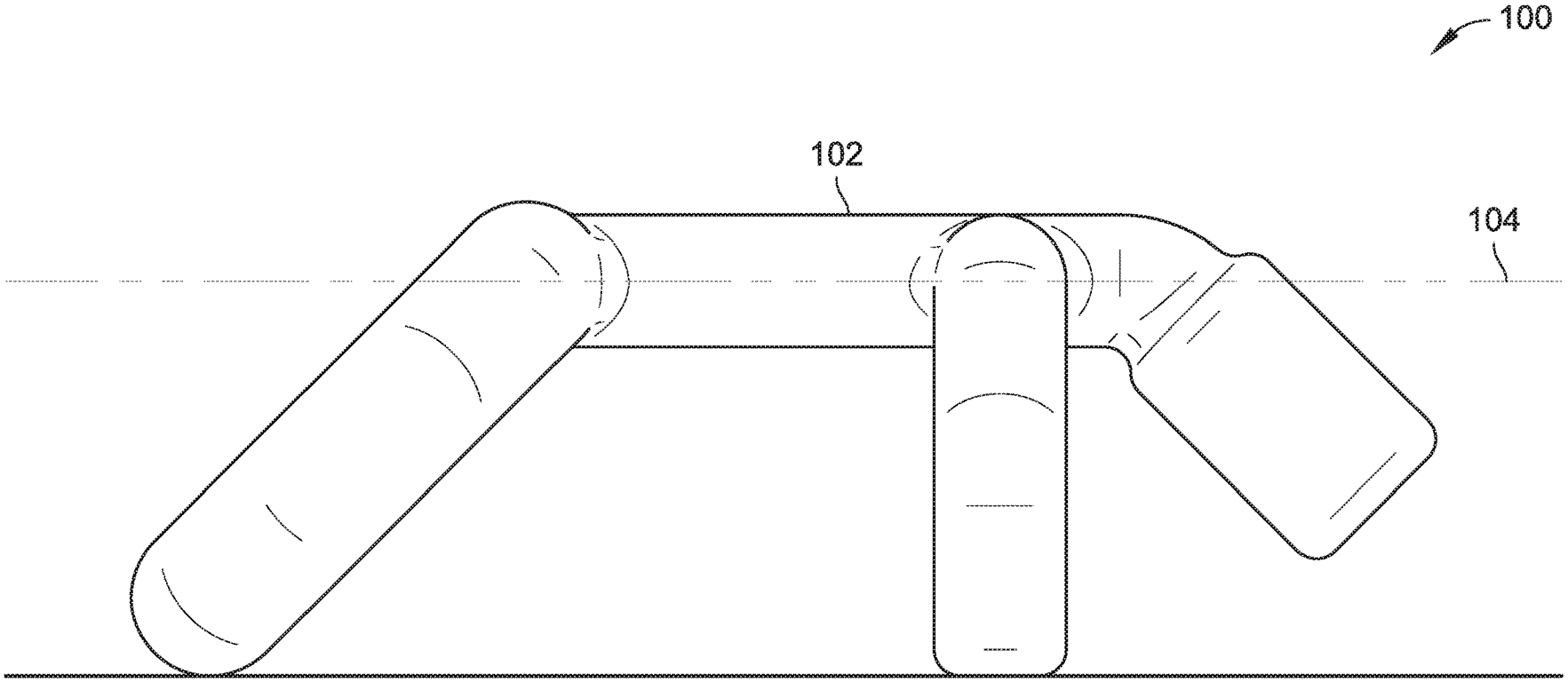
FIG. 26 is a side elevation view illustrating a grappling dummy, such as the grappling dummy illustrated in FIG. 1, in accordance with an example embodiment of the present disclosure.
Figure 27:
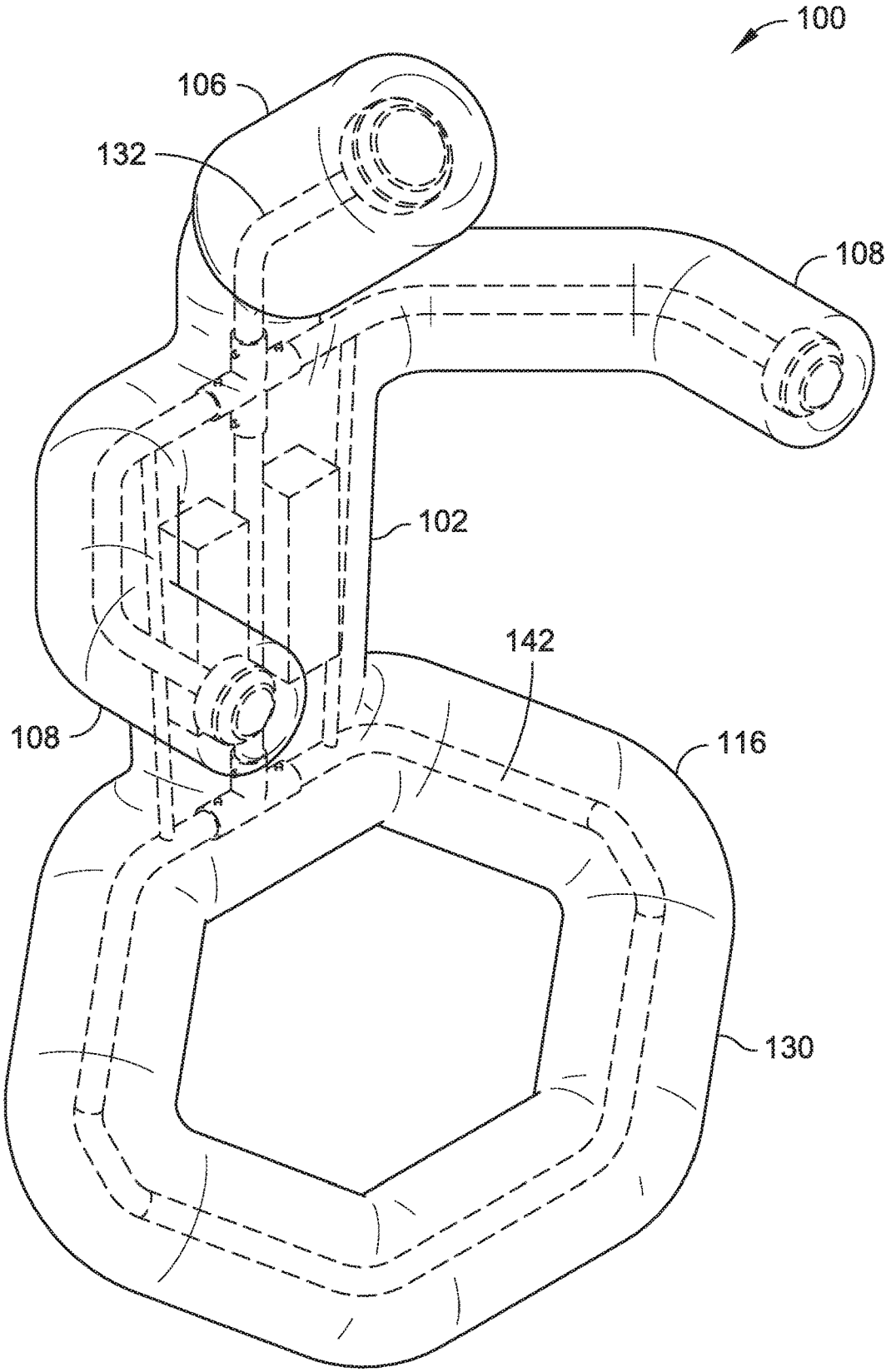
FIG. 27 is an isometric view illustrating a grappling dummy in accordance with example embodiments of the present disclosure.
Figure 28:
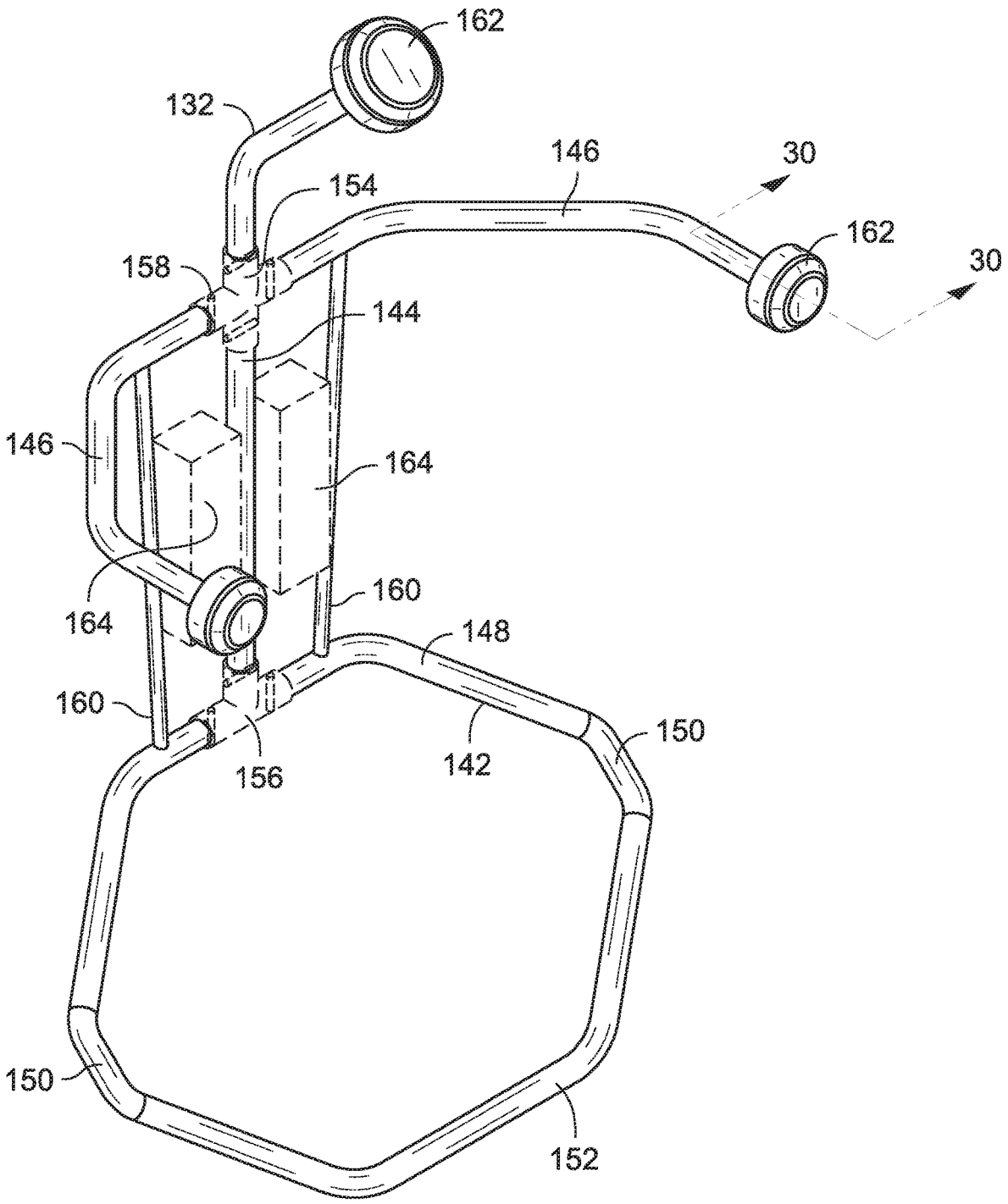
FIG. 28 is an isometric view illustrating a frame for a grappling dummy, such as the grappling dummy illustrated in FIG. 27, in accordance with example embodiments of the present disclosure.
Figure 29:
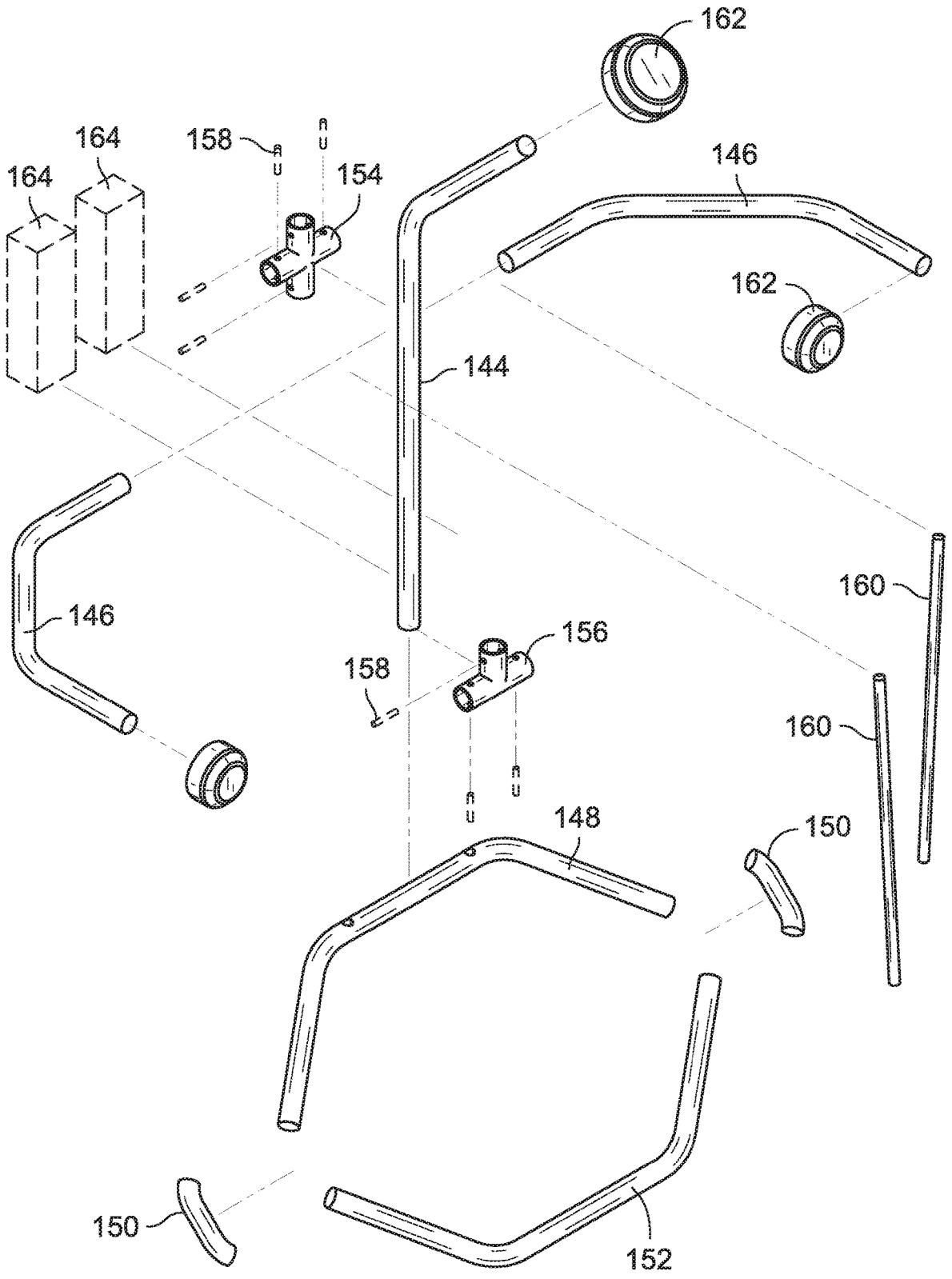
FIG. 29 is an exploded isometric view of the frame illustrated in FIG. 28.
Figure 30:
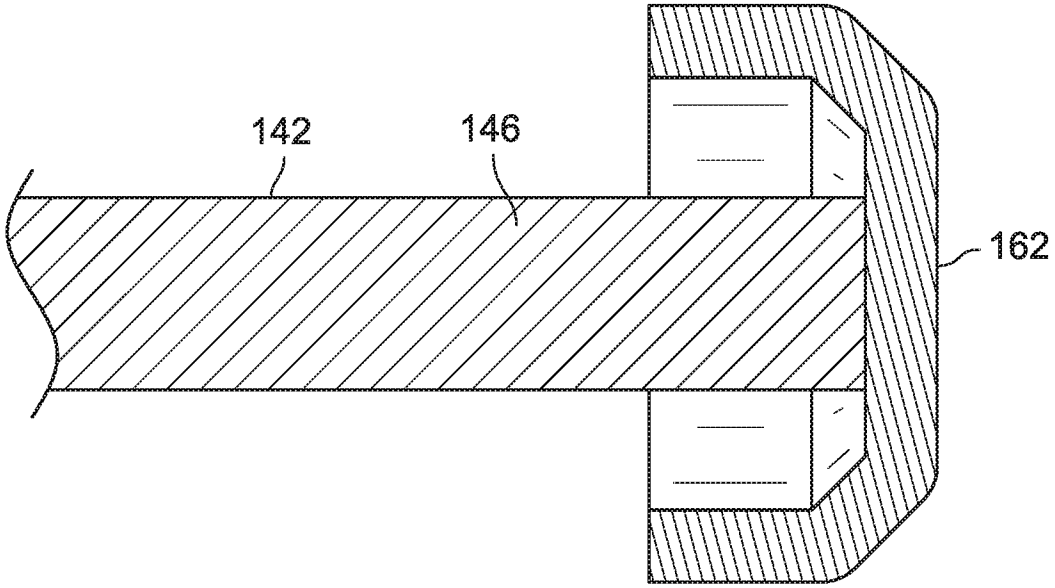
FIG. 30 is a partial cross-sectional side elevation view of an arm segment and a cup for the frame illustrated in FIG. 28.

Referring now to FIG. 26, the midline 104 and the trunk 102 of the grappling dummy 100 can be generally parallel to the ground when the grappling dummy 100 is oriented in the kneeling or turtle position. With reference to FIGS. 27 through 30, the rigid internal frame 132 of the grappling dummy 100 can be constructed from sections of rod 142 (e.g., steel rod, steel pipe, and/or rod or pipe formed from another rigid or semi-rigid material). For example, one-inch (1") diameter rod 142 can be used for a spine and head segment 144 of the rigid internal frame 132, while similar rod 142 can be used for arm segments 146, a hip and proximal leg segment 148, knee segments 150, and/or a distal leg and foot segment 152. For example, the hip and proximal leg segment 148, the knee segments 150, and the distal leg and foot segment 152 can be welded together to form the portion of the rigid internal frame 132 for the leg enclosure 116. In some embodiments, the rod 142 can be annealed, e.g., to relieve stress from a bending process used to form the rod 142 into its final shape.

Further, pipe fittings and/or other fittings can be used to connect the various segments of rod 142 together. For instance, the spine and head segment 144 can be coupled with the arm segments 146 by a first fitting 154. Similarly, the hip and proximal leg segment 148, the knee segments 150, and the distal leg and foot segment 152 can be coupled with the spine and head segment 144 by a second fitting 156. In some embodiments, one or more pins 158 (e.g., anti-rotation pins) can be used to lock the segments of rod 142 together at the fittings 154 and/or 156. Further, in some embodiments, one or more (e.g., two (2)) additional spine rods 160 can be used to strengthen the core of the rigid internal frame 132 and prevent or reduce twisting when grappling with the dummy. For example, a one-half inch (½") diameter spine rod 160 can be positioned on either side of the spine and head segment 144 and inserted into apertures formed in an arm segment 146 and the hip and proximal leg segment 148. The spine rods 160 can be connected to the arm segments 146 and/or the hip and proximal leg segment 148 using various techniques and apparatus, including, but not necessarily limited to, fittings, pins, welding, and so on. For instance, a spine rod 160 can be welded to an arm segment 146 and/or a hip and proximal leg segment 148.

In some embodiments, the grappling dummy 100 can include one or more cups 162 for shielding the padding 130 from ends of the rod 142. For example, a cup 162 may be constructed from three-eighths inch (⅜") steel and welded (e.g., fillet welded) to an end of a rod 142 (e.g., at an end of an arm segment 146, an end of a spine and head segment 144, and so forth. In some embodiments, the grappling dummy 100 can also include one or more weighted pouches 164, such as pouches weighted with lead shot or another heavy material. Such pouches may be used to adjust the weight distribution of the grappling dummy 100, the center of gravity of the grappling dummy 100, and so forth. For example, weighted pouches 164 can be positioned between adjacent spine segments of the grappling dummy 100 (e.g., between, for instance, the spine and head segment 144 and a spine rod 160).

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A grappling dummy having a generally human shape, the grappling dummy comprising:

a trunk defining a midline;

a head extending longitudinally from the trunk and angled in a forward direction from the midline of the trunk at about forty-five degrees;

two arms, each one of the two arms including a proximal arm segment extending from the trunk at about forty-five degrees and a distal arm segment extending from the proximal arm segment at about forty-five degrees, each one of the proximal arm segments and the distal arm segments lying in a generally transverse plane with respect to the midline of the trunk;

a leg enclosure, the leg enclosure configured to be worn around the waist of a user including a first proximal leg segment extending from the trunk at about forty-five degrees and a first distal leg segment extending from the first proximal leg segment at about ninety degrees, an opposing second proximal leg segment extending from the trunk at about forty-five degrees and a second distal leg segment extending from the second proximal leg segment at about ninety degrees, the first distal leg segment and the second distal leg segment connected together and spaced apart by an elongate connecting leg segment, each one of the first proximal leg segment, the first distal leg segment, the second proximal leg segment, the second distal leg segment, and the connecting leg segment lying in a second plane angled in a forward direction from the midline of the trunk at about forty-five degrees; and padding disposed about the trunk, the head, the two arms, and the leg enclosure.

2. The grappling dummy as recited in claim 1, further comprising a rigid internal frame for supporting the padding.

3. The grappling dummy as recited in claim 2, wherein the rigid internal frame comprises sections of at least one of pipe or rod.

4. The grappling dummy as recited in claim 2, wherein the rigid internal frame comprises at least two spines at the trunk.

5. The grappling dummy as recited in claim 2, further comprising at least one of a cap or a cup disposed at an end of the rigid internal frame.

* * * * *